US007531737B2

(12) United States Patent
Ide et al.

(10) Patent No.: US 7,531,737 B2
(45) Date of Patent: May 12, 2009

(54) MUSIC PROCESSING APPARATUS AND MANAGEMENT METHOD THEREFOR

(75) Inventors: Kensuke Ide, Hamamatsu (JP); Atsushi Fukada, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/729,149

(22) Filed: Mar. 27, 2007

(65) Prior Publication Data

US 2007/0227342 A1 Oct. 4, 2007

(30) Foreign Application Priority Data

Mar. 28, 2006 (JP) ..... 2006-087091
Mar. 30, 2006 (JP) ..... 2006-093133

(51) Int. Cl.
*G10H 7/00* (2006.01)

(52) U.S. Cl. ..... 84/645; 84/601; 84/602; 84/609

(58) Field of Classification Search ..... 84/601, 84/602, 609, 645
See application file for complete search history.

(56) References Cited

U.S. PATENT DOCUMENTS

2001/0021188 A1* 9/2001 Fujimori et al. ..... 370/389
2005/0038922 A1* 2/2005 Yamamoto et al. ..... 710/1
2005/0159832 A1* 7/2005 Umeo et al. ..... 700/94
2005/0204902 A1 9/2005 Shibukawa
2006/0054004 A1* 3/2006 Funaki ..... 84/600
2006/0248173 A1* 11/2006 Shimizu ..... 709/220

FOREIGN PATENT DOCUMENTS

EP 1117226 7/2001
EP 1507359 2/2005
EP 1555772 7/2005

OTHER PUBLICATIONS

Wiffen, P: MLAN's Promise: Audio & MIDI Down the Same Wire, Keyboard, Music Player Network, San Francisco, CA US, vol. 27, No. 2, Feb. 2001, pp. 40-42, 44, X001101835.

* cited by examiner

*Primary Examiner*—Jeffrey Donels
*Assistant Examiner*—Kawing Chan
(74) *Attorney, Agent, or Firm*—Morrison & Foerster LLP

(57) ABSTRACT

As a music equipment is connected to a music processing apparatus, necessary communication ports corresponding to the connected music equipment are automatically set in the processing apparatus. The thus-set communication ports are each assigned the name of the corresponding equipment so that the equipment and the communication ports can be associated with each other. Once the equipment is disconnected from the apparatus, the disconnected equipment is converted into a dummy state and displayed in a predetermined dummy display style. When a project file has been read which includes track data, identification information of a currently-set external equipment and parameters of the external equipment, the detected external equipment is associated with any one of external equipments which had been set for use at the time of storage of the project file. By transferring parameters, stored in a memory, to the external equipment that could be associated, parameter synchronization can be effected.

11 Claims, 16 Drawing Sheets

MUSIC PROCESSING APPARATUS AND MANAGEMENT METHOD THEREFOR

BACKGROUND OF THE INVENTION

The present invention relates to a music processing apparatus which is capable of performing various music processing, such as recording/reproduction, editing, mixing, etc. of performance events and audio signals and which is also capable of registering therein plug-in software, equipped with a predetermined music function, to thereby use the music function of the plug-in software in part of the music processing.

Heretofore, there has been known application software called "DAW" (Digital Audio Workstation) to be installed in personal computers. Each personal computer where the DAW has been activated can function as a music processing apparatus to perform various music processing, such as recording/reproduction, editing, mixing, etc. of MIDI events and audio signals. In such a music processing apparatus, there are created, for each music file, MIDI tracks for recording MIDI events, audio tracks for recording audio signals and buses for mixing audio signals. MIDI channel strips and audio channel strips are created in corresponding relation to the individual tracks. Various operators are provided in each of the MIDI channel strips, so that, in response to user's operation any of the operators, control can be performed on a tone volume (expression), tone image localization (panning or pan), etc. of a MIDI event to be reproduced via the corresponding MIDI track. Further, in response to user's operation of any of operators provided in each of the audio channel strips, control is performed on frequency characteristics, tone volume, tone image localization, etc. of an audio signal.

Further, for addition of desired functions, the music processing apparatus are provided with one or more musical instrument plug-ins and effector plug-ins. The "plug-in" is a program for providing an additional function to application software. With a musical instrument plug-in, it is possible to add to the music processing apparatus an analog synthesizer, sampler or software tone generator dedicated to generation of tones of a piano, guitar or the like. With an effector plug-in, it is possible to add to the music processing apparatus a software effector, such as a reverberator, compressor, equalizer or the like. To use the software tone generator added by the musical instrument plug-in, the music processing apparatus performs a registration process for registering the software tone generator by opening a registration screen. To use the software effector added by the effector plug-in, the music processing apparatus performs an insertion process for inserting the software effector in a desired audio channel. By the registration process or insertion process being performed, the program of the musical instrument plug-in or effector plug-in can be executed so that a port is set for exchanging or communicating data between the music processing apparatus and the software tone generator or software effector. The port is assigned the name of the software tone generator or software effector through a registration process.

Further, by externally connecting hardware music equipments to the music processing apparatus, a hardware tone generator and hardware effector can be added to the music processing apparatus. Such external music equipments are connected to static ports, such as an analog output port, analog input port, SPDIF input/output ports, MIDI input port and MIDI output port, which are individual terminals of a music I/O section of the music processing apparatus. Further, where external music equipments are connected to a music network connected with a music network I/O of the music I/O section of the music processing apparatus, audio and MIDI input/output ports are dynamically formed in each of the music equipments and music processing apparatus, and logical connection is made between these dynamically-formed ports. Further, the externally-connected hardware tone generator and hardware effector can be used like a musical instrument plug-in and effector plug-in in the music processing apparatus by the user setting the names of the hardware tone generator and hardware effector and setting ports connected therewith. When any desired music equipment is externally connected to the music processing apparatus, ports are set on the basis of port-related information acquired by the music processing apparatus inquiring of the connected music equipment. Further, in order to use a hardware tone generator added the music processing apparatus through external connection, it is only necessary for the music processing apparatus to open a registration screen and perform a registration process to register the hardware tone generator. Furthermore, in order to use a hardware effector added through external connection, the music processing apparatus performs an insertion process to insert the hardware effector in a desired audio channel. Namely, various tone generators can be added to the music processing apparatus by the user adding hardware tone generators to the apparatus, and various effectors can be added to the music processing apparatus by the user adding hardware effectors to the apparatus.

With the static ports of the conventionally-known music processing apparatus, however, it is not possible to, at the time of external connection of a music equipment, identify what type of equipment has been connected to any one of the ports and acquire the name of the connected music equipment. Further, with the dynamic ports of the conventionally-known music processing apparatus, information related to the name and type of the connected music equipment, connection ports therefor of the music processing apparatus, etc. are retained only in control processing pertaining to the music I/O section and can not be used in other processing of the music processing apparatus, although generation of each port necessary for the connection and connection between the ports are automatically carried out. Thus, if the added music equipment is to be used as a music instrument plug-in or effector plug-in, the name of the connected music equipment, information about the port the music equipment has been connected to, information about remote control software of the music equipment, etc. must be manually set, which would involve cumbersome and complicated setting operation. Furthermore, even when any externally-connected music equipment has been disconnected from the music processing apparatus by erroneous operation or by accident, a display screen displaying the name of the music equipment is left unchanged, so that it is difficult for the user to become aware of the disconnection of the music equipment. Furthermore, when the music equipment has been re-connected to the music processing apparatus by the user after becoming aware of the disconnection, the user has to manually set necessary data again because the data previously set in the music equipment have been deleted.

Besides, although the conventional music processing apparatus can be externally connected with one or more music equipments to use music functions of the music equipments as part of their music processing, it would be cumbersome and complicated to perform setting of the music equipments each time the music processing apparatus is activated. Thus, it has been proposed to store in advance, into a project file, the music equipments currently being used in the music processing apparatus and data of settings (i.e., setting data) of the music equipments and then reproduce states of the music processing apparatus by reading the project file. However, logical paths between the music processing apparatus and the music equipments are sequentially set, in accordance with user's instructions, in a music LAN (Local Area Network) externally connecting the music equipments to the music processing apparatus, and which logical paths are used by which music equipments would vary depending on the order in which the user has instructed connections. Further, when the individual music equipments in the music LAN are powered on, the logical paths that were being used immediately before last powering-off are automatically restored, but, which logical paths are used by which music equipments would vary depending on timing at which the individual music equipments are powered on. Thus, even where the user powers on the music equipments in the same order as before, the same logical paths as before can not necessarily be set. Furthermore, parameters for controlling the music equipments might have been varied from those originally stored in the project file, and thus, the same musical functions of the music equipments as when the project file was stored can not be restored, which would result in music functions different from the intended music functions.

SUMMARY OF THE INVENTION

In view of the foregoing, it is an object of the present invention to provide a music processing apparatus which can readily perform necessary setting when an equipment externally connected to the apparatus is to be used.

It is another object of the present invention to provide a music processing apparatus which can restore, from a project file, the same music function of a music equipment as when the project file was stored.

In order to accomplish the above-mentioned objects, the present invention provides an improved music processing apparatus, which is characterized by: detecting an external equipment connected thereto and generating equipment data of the detected external equipment on the basis of information acquired from the detected external equipment to store the generated equipment data in a library; and registering an equipment, registered for use in the music processing apparatus (i.e., of which use-registration has been made from among equipments stored in the library), into a rack object. With such arrangements, the present invention allows the function of the thus-registered equipment as part of music processing to be performed by the music processing apparatus.

More specifically, when a music equipment has been externally connected to the music processing apparatus, the connected external equipment is detected, and equipment data of the detected external equipment is generated on the basis of information acquired from the detected external equipment and stored into the library. Equipment, registered for use in the music processing apparatus (i.e., of which use-registration has been made from among equipments stored in the library), is registered into the rack object, so that the function of the thus-registered equipment can be used as part of the desired music processing. Thus, by registering a desired music equipment, externally connected to the music processing apparatus, into the rack object when using the desired music equipment, the present invention can use the function of the desired music equipment as part of the desired music processing.

According to another aspect of the present invention, upon reading of a project file including track data, identification information of an external equipment, duly set for use in the music processing apparatus, and parameters of the external equipment, the detected external equipment is associated with any one of external equipments which, at the time of storage of the project file, had been duly set for use in the apparatus. By transferring parameters, stored in a parameter storage section, to the external equipment that could be associated, the present invention can effect parameter synchronization between the external equipment and the parameter storage section. With such arrangements, the present invention can restore the same music function of the external equipment, which could be associated, as when the project file was stored.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Figure 1:
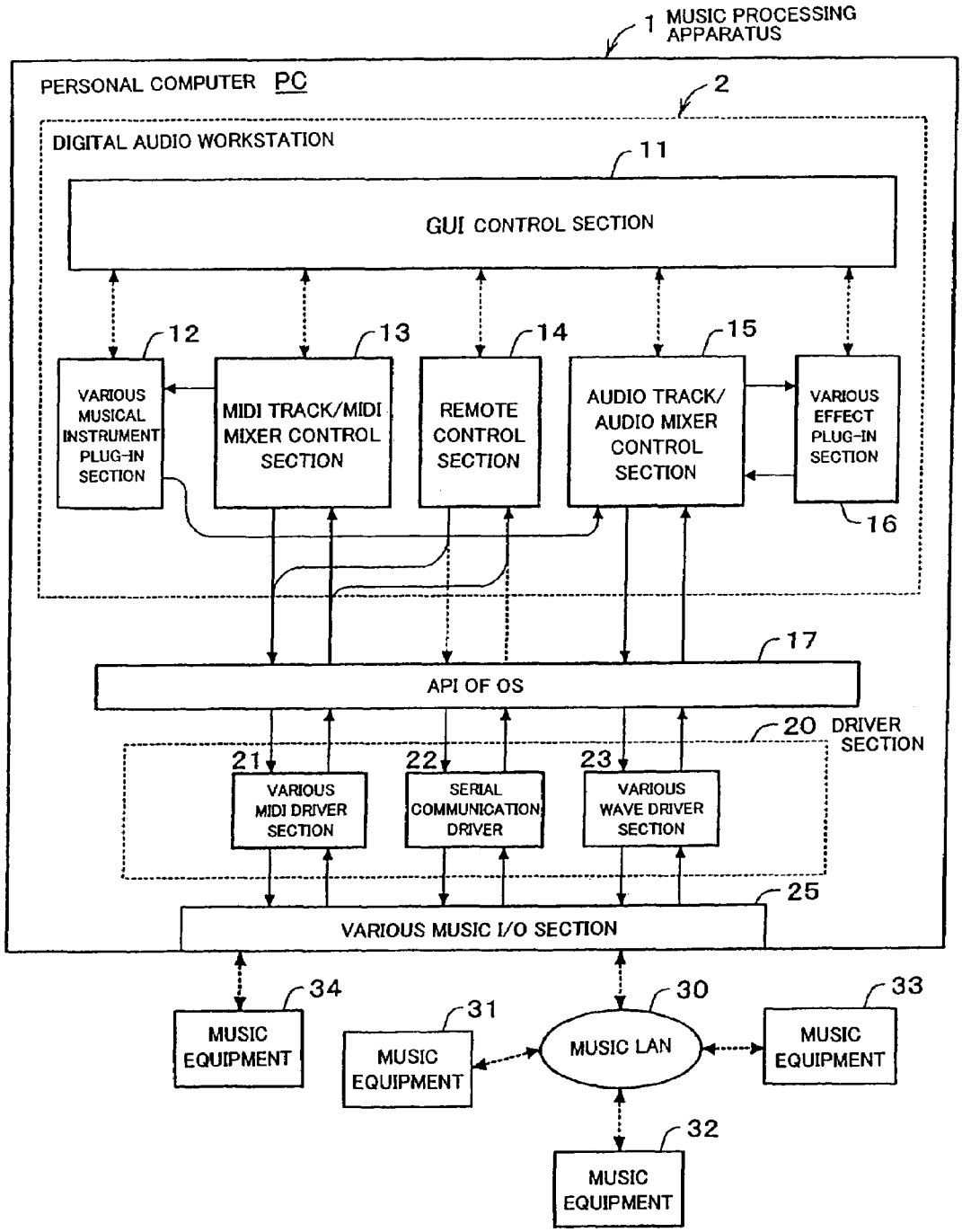
FIG. 1 is a block diagram of a music processing apparatus in accordance with an embodiment of the present invention.

FIG. 1 is a block diagram of a music processing apparatus in accordance with an embodiment of the present invention. The music processing apparatus 1 of FIG. 1 is implemented by application software, called "DAW" (Digital Audio Workstation), running under an OS (Operating System) of a personal computer PC; namely, the music processing apparatus 1 is implemented by the personal computer where the DAW 2 is running. The music processing apparatus 1 performs various music processing, such as recording/reproduction, editing, mixing, etc. of MIDI events and audio signals.

The music processing apparatus 1 is arranged to allow a human operator or user to create, for each music file called "project", desired numbers of MIDI tracks for recording MIDI events, audio tracks for recording audio signals and buses for mixing audio signals. Each of the MIDI tracks can selectively record a MIDI event input from one of one or more MIDI input ports/channels provided in the music processing apparatus 1, and any desired one of a plurality of MIDI output ports/channels provided in the music processing apparatus 1 can be selected as a destination of a MIDI event reproduced from the MIDI track. Each time the user creates a MIDI track, a display of a MIDI channel strip corresponding to the created MIDI track is added to a MIDI mixer screen.

Thus, MIDI channel strips corresponding to outputs of the individual MIDI tracks are present on the MIDI mixer screen, and the user can create a desired number of MIDI channel strips on the MIDI mixer screen. The user is allowed to not only select a desired output destination of a MIDI event for each of the former MIDI channel strips, but also select a desired input source of a MIDI event and output destination of a MIDI event for each of the latter MIDI channel strips. In response to operation of any of operators provided in each of the MIDI channel strips, control can be performed on a tone volume (expression), tone image localization (panning), muting, etc. of a MIDI event to be reproduced via the corresponding MIDI track.

Further, for each of the audio tracks, the user is allowed to select, as an input source of an audio signal input for recording, any desired one of a plurality of audio input ports provided in the music processing apparatus and buses of an audio mixer. Also, the user is allowed to select, as an output destination of an audio signal reproduced from an audio track (i.e., output destination of the corresponding audio channel), any desired one of a plurality of audio output ports and buses of the audio mixer. In this case, an audio channel is automatically inserted between the audio track and the selected output destination. Each time the user creates an audio track, a display of a MIDI channel strip corresponding to the created MIDI track is added to an audio mixer screen. Further, each time the user creates a bus, a display of an audio channel strip corresponding to the output of the created bus is added to the audio mixer screen. Thus, audio channel strips corresponding to the audio tracks and buses are provided on the audio mixer screen.

Further, the user can create a desired number of audio channel strips. The user is allowed to not only select a desired output destination for each of the former audio channel strips of audio tracks and buses, but also select a desired input source and output destination for each of the latter audio channel strips. More specifically, for each of the channel strips of the audio channels, the user is allowed to select, as an input source of an audio signal, any desired one of a plurality of audio input ports and audio tracks provided in the music processing apparatus 1 and buses of the audio mixer. Also, the user is allowed to select, as an output destination of an audio signal, any desired one of the plurality of audio output ports provided in the music processing apparatus 1 or buses of the audio mixer. In response to operation of any of operators provided in each of the MIDI channel strips on the audio mixer screen, control can be performed on frequency characteristics, tone volume, tone image localization, etc. of an audio signal in the corresponding audio channel. Further, each of the buses mixes audio signals of one or more input audio signals, and the thus-mixed audio signals are supplied to corresponding audio channel strips.

To the music processing apparatus 1 can be added, by plug-in, not only a software tone generator (software T.G.) but also a software effector. The software tone generator is provided by a musical instrument plug-in, which can add to the music processing apparatus 1 an analog synthesizer, sampler or software tone generator dedicated to generation of tones of a piano or guitar. Further, the software effector is provided by an effector plug-in, which can add to the music processing apparatus 1 a software effector, such as a reverberator, compressor or equalizer. Note that each plug-in is a program for providing an additional function to the application software (DAW).

First describing the musical instrument plug-in, once the DAW 2 is activated with files of one or more musical instrument plug-in software placed in a predetermined folder of the music processing apparatus 1, information of the musical instrument plug-in software is read into the DAW 2, and names of software tone generators (musical instruments) corresponding to the musical instrument plug-in software are added to a tone generator menu, displayed on a tone generator rack that is a rack object of the DAW 2, for selection by the user. Once any one of the software tone generators is selected and registered in the tone generator rack, the program of the selected software tone generator is started up so that one or more MIDI output ports/channels and audio input ports are generated. In this case, the MIDI output port/channel is a virtual port for the DAW 2 to provide a MIDI event to the corresponding software tone generator, and the audio input port is a port for the DAW 2 to receive an audio signal (tone) generated by the corresponding software tone generator. Each of the MIDI output ports and audio input ports is assigned the name of the corresponding software tone generator (musical instrument), so that the user is allowed to readily select, per MIDI track or MIDI channel, a MIDI output port of the corresponding software tone generator as a MIDI event output destination and similarly the user is allowed to readily select, per audio track or audio channel, an audio input port of the corresponding software tone generator as an audio signal input source. The registered software tone generator generates and mixes a plurality of audio signals in response to a MIDI event supplied from the DAW 2 via a MIDI output port to the software tone generator and outputs the resultant mixed audio signals to the DAW 2 via the audio input port.

Each musical instrument plug-in software contains a program of an editor, and by opening a parameter editing screen of a corresponding editor of each software tone generator registered in the tone generator rack, operational data, such as tone color parameters and tone generator parameters, of the software tone generator can be edited. The parameter editing screen is opened in response to operation of any one of edit buttons provided in corresponding relation to the software tone generators registered in a display screen of the tone generator rack, edit buttons provided on a display screen of a MIDI track having the software tone generator set as an output destination of MIDI events and edit buttons provided on a display screen of an audio channel strip having the software tone generator set as an input source of audio signals.

Next describing the effector plug-in, once the DAW 2 is activated with files of one or more effector plug-in software placed in a predetermined folder of the music processing apparatus 1, information of the effector plug-in software is read into the DAW 2, and names of software effectors corresponding to the effector plug-in software are added to an effector menu, displayed on an insertion setting section for audio channel strips of the DAW 2, for selection by the user. Once any one of the software effectors is selected and inserted in an audio channel strip, the program of the selected software effector is started up so that one or more audio output ports and audio input ports are generated. To each of the audio output ports is connected an output terminal immediately preceding an insertion point of the audio channel, and to each of the audio input ports is connected an input terminal immediately following the insertion point. In this way, the software effector is inserted in the audio channel. To the inserted effector is input an audio signal from processing that immediately precedes the insertion point of the audio channel, so that an audio signal imparted with an effect through a predetermined effect impartment process is output to processing that immediately follows the insertion point of the audio channel. Each effector plug-in software contains a program of an editor, and by opening a parameter editing screen of a corresponding editor of each software effector, operational data, such as effect parameters, can be edited. The parameter editing screen is opened in response to operation of an effect edit button of the audio channel strip where the software effector has been inserted.

Further, hardware tone generators and hardware effectors can be added, as external equipments, to the music processing apparatus 1 by hardware music equipments 31-34 being externally connected to the apparatus 1 and respective equipment data of the equipments 31-34 being set in a manner to be described below; note that the equipment data of each of the equipments is a set of data pertaining to the equipment. More specifically, by externally connecting the music equipments 31-34 to the music processing apparatus 1 and setting the respective equipment data, there can be added to the music processing apparatus 1 desired ones of hardware tone generators, such as a waveform memory tone generator and physical model tone generator, synthesizer equipped with a keyboard, musical instruments, such as an electronic piano and guitar, and hardware effectors, such as a reverberator, compressor and equalizer. Once any one of the music equipments 31-34 is externally connected to the music processing apparatus 1 via a music LAN 30, logical paths for exchanging data, such as MIDI events and audio signals, are set automatically or manually, and, on the basis of information acquired from the connected music equipment by the music processing apparatus 1 inquiring of the music equipment, the name of the music equipment and association or correspondency with the controlling editor (remote control software) are set, desired numbers of MIDI input/output ports and audio input/output ports are set, and individual correspondency of the music equipment with the ports is set. The ports function as sub-addresses of the logical paths. For the music equipment 34 connected to the MIDI output port and analog input/output ports that are static ports, setting of the name of the music equipment, association with the editor, numbers of the ports, association with the ports, etc. is performed manually because the music processing apparatus 1 is unable to acquire the aforementioned information from the music equipment 34. To use the hardware tone generator of any of the music equipments 31-34 having the corresponding equipment data set in the music processing apparatus 1, a registration screen of the tone generator rack provided in the music processing apparatus 1 is opened for the user to register the hardware tone generator. Thus, for each of the MIDI tracks or MIDI channels, the user is allowed to select, as an output destination of a MIDI event, the MIDI output port to which the hardware tone generator is connected, on the basis of the name of the hardware tone generator. Also, for each of the audio tracks or audio channel strips, the user is allowed to select, as an input source of an audio signal, the audio input port to which the hardware tone generator is connected, on the basis of the names of the hardware tone generators. In this case, the name of the port for the music equipment in the form of a hardware tone generator is replaced with (i.e., changed to) the name of the hardware tone generator (musical instrument) when the hardware tone generator has been registered into the tone generator rack, and the name of the port for the music equipment in the form of a hardware effector is replaced with the name of the hardware effector has been inserted in the audio channel. Because the names of the hardware tone generators (musical instruments) are assigned to the corresponding ports in the aforementioned manner, any desired one of the ports can be selected by the user with utmost ease. Each of the registered hardware tone generators generates and mixes one or more audio signals in response to a MIDI event supplied thereto via a MIDI output of the music processing apparatus 1 and outputs the resultant mixed audio signals to the music processing apparatus 1 via an audio input port.

To use the hardware effector added through external connection, the music processing apparatus 1 only has to perform an insertion process for inserting the hardware effector at an insertion point of a desired audio channel. Here, if the association or correspondency between the name of the hardware effector and the ports has been set, the insertion can be instructed using the name of that effector. Output terminal immediately preceding the insertion point of the audio channel is connected to the audio output port of any designated hardware effector, and an input terminal immediately following the insertion point of the audio channel is connected to the audio input port. In this way, the hardware effector is inserted in the audio channel strip. To the inserted hardware effector is input an audio signal from processing that immediately precedes the insertion point of the audio channel, so that an audio signal imparted with an effect through a predetermined effect impartment process is output to processing that immediately follows the insertion point of the audio channel.

Parameter editing of each of the hardware tone generators and hardware effectors can be performed in a similar manner to parameter editing of the software tone generators and software effectors.

As set forth above, various tone generators (musical instruments) can be added to the music processing apparatus 1 by adding musical instrument plug-ins and hardware tone generators to the apparatus 1, and various effectors can be added to the music processing apparatus 1 by adding effect plug-ins and hardware effectors.

Referring back to FIG. 1, the DAW 2 in the music processing apparatus 1 includes a GUI control section 11. GUI (Graphical User Interface) in the GUI control section 11 is a user interface that allows the user to perform most of necessary operation via a pointing device, such as a mouse, using graphics for to visually display information to the user. The GUI control section 11 allows the user to perform various setting in a various musical instrument plug-in section 12, MIDI track/MIDI mixer control section 13, remote control section 14, audio track/audio mixer control section 15 and various effect plug-ins 16 through simple operation by operating the mouse etc. on a setting screen displayed by the GUI control section 11. In this way, the aforementioned selection, setting, parameter editing, etc. can be carried out by the user operating the mouse etc. on the setting screen.

The various musical instrument plug-ins 12 comprise musical instrument plug-in software having been activated after being registered in the tone generator rack from among musical instrument plug-in software having their files placed in a plug-in folder. The various effect plug-ins 16 comprise effector plug-in software having been activated after being inserted in audio channel strips from among effector plug-in software having their files placed in a plug-in folder.

Further, the MIDI track/MIDI mixer control section 13 performs MIDI track/MIDI mixer control that includes setting of an input source and output destination of a MIDI event in each of the MIDI tracks and an input source and output destination of a MIDI event of each MIDI channel in the MIDI mixer. Setting of the MIDI event input source and output destination can be performed by the user operating the mouse etc. on a setting screen displayed by the GUI control section 11, like various other setting.

The audio track/audio mixer control section 15 performs audio track/audio mixer control that includes setting of an input source and output destination in each of the audio tracks and an input source and output destination of a bus in the audio mixer. Setting of the input source and output destination can be performed by the user operating the mouse etc. on a setting screen displayed by the GUI control section 11.

The remote control section 14 can set, edit and control various parameters and various settings of any of the music equipments 31-34 externally connected to the music processing apparatus 1. In this case, the remote control section 14 can control various parameters and various settings of any of the music equipments 31-34 by communicating with the equipment 31-34 through serial communication. In the remote control section 14, an editing screen is opened in response to operation of any one of edit buttons corresponding to the music equipments 31-34, and editing and setting of various parameters of the music equipment 31-34 is instructed by the user operating the mouse etc. on the setting screen. Note that the remote control section 14 may communicate with the music equipments 31-34 via MIDI communication paths.

API (Application Programming Interface) of the OS (Operating System) is provided between the MIDI track/MIDI mixer control section 13, remote control section 14 and audio track/audio mixer control section 15 and a group of drivers 20. The "API" is an entry to functions available to the application software and prepared via the OS and in a programming language, which is provided as functions for file control, window control, image process, character control, etc. The driver group 20 includes a plurality of types of drivers that are software for causing the connected music equipments 31-34 to operate. More specifically, the driver group 20 includes a various MIDI driver section 21 provided for various MIDI equipments, serial communication driver 22, and various WAVE driver section 23 provided for various audio equipments. These drivers are connected to the music equipments 31-34 via a various music I/O section 25. The various music I/O section 25 include at least a MIDI I/O port, serial I/O port and audio I/O port. Music equipment provided with an interface capable of being connected directly to the music processing apparatus 1, such as the music equipment 34, is connected directly to the various music I/O section 25 of the music processing apparatus 1. The music LAN (Local Area Network) 30 is connected to the various music I/O section 25, and the music equipments 31, 32 and 33 are connected to the network of the music LAN 30. The music LAN 30 comprises any of the IEEE1396, USB (Universal Serial Bus), Ethernet, mLAN (registered trademark), etc., and is constructed as a music network capable of transmitting in real time MIDI events, audio signals, serial signals, etc. Each of the music equipments connected to the music LAN is provided with logical input/output ports, in a hardware manner, for transmitting MIDI events, audio signals, serial signals, etc. In the music processing apparatus 1, on the other hand, logical input/output ports are generated, in a software manner, in accordance with each music equipment to be connected, and logical connections for transmission of MIDI events and audio signals are made between the music processing apparatus 1 and the input/output ports of the individual music equipments.

Thus, where any one of the music equipments 31-34 has been set as an input source of a given MIDI track, a MIDI event from a MIDI output port of the music equipment 31-33, which is assumed to be a MIDI keyboard, is introduced to the music processing apparatus 1 via the MIDI input port of the various music I/O section 25, then passed to the DAW 2 through the functions of the various MIDI driver section 21 and API 17 of the OS, and ultimately supplied to the MIDI track in question under control of the MIDI track/MIDI mixer control section 13. Further, in a case where a particular MIDI output port connected to the MIDI input port of any one of the music equipments 31-33 each in the form of a hardware tone generator is set as an output destination of a MIDI event of a given MIDI track but also a particular audio input port connected to the audio output of the music equipment 31-33 is set as an input source of an audio signal of a given audio track/audio mixer bus, a MIDI event output from the MIDI track under control of the MIDI track/MIDI mixer control section 13 is passed to the various music I/O section 25 through the functions of the API 17 of the OS and various MIDI driver section 21 and then supplied to the music equipment 31-34 as the hardware tone generator via the MIDI output port. In that hardware tone generator, one or more audio signals (tones) are generated on the basis of the supplied MIDI event, and these audio signals are introduced via the audio input port of the various music I/O section 25. The thus-introduced audio signals are passed to the DAW 2 through the functions of the various WAVE driver section 23 and API 17 of the OS and then supplied to a bus of the audio track/audio mixer having been set under control of the audio track/audio mixer control section 15.

Further, the remote control section 14 for setting various parameters and the like of the music equipments 31-34 externally connected to the music processing apparatus 1 edits various parameters and makes various settings of the music equipments 31-34 through serial communication with the music equipments 31-34 using the serial communication driver 22 and serial I/O port of the various music I/O section 25. There is provided a parameter memory, in the music processing apparatus 1, for storing the parameters set for each of the music equipments 31-34. The parameter memory may be comprises a non-volatile readable/writable memory device such as a hard disk 3A or flash memory 3B provided in the personal computer PC as shown in FIG. 28, or a volatile readable/writable memory device such as RAM (Random Access Memory) 4 provided in the personal computer PC.

Figure 28:
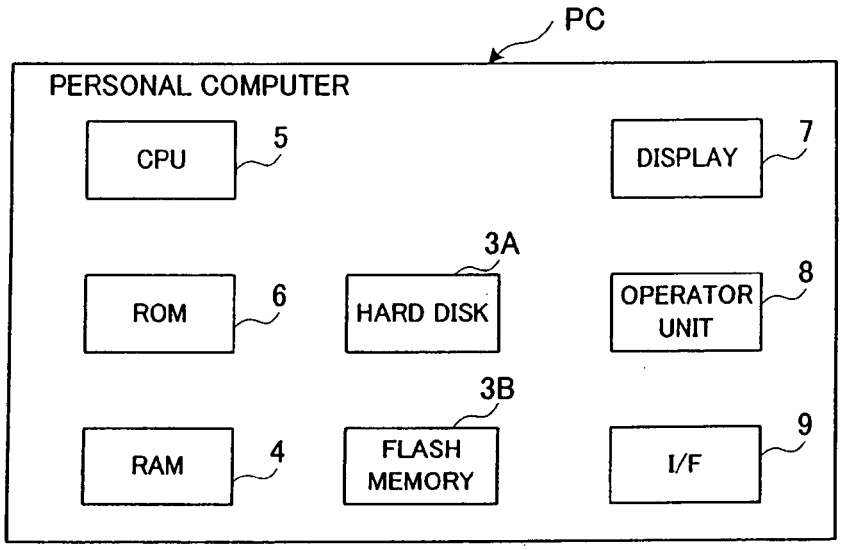
FIG. 28 is a schematic block diagram of a personal computer implementing the music processing apparatus.

FIG. 28 shows a schematic block diagram of the personal computer PC implementing the music processing apparatus 1. As well known, the personal computer PC includes not only the memory device such as the RAM 4 functioning as a working memory on running of a program, the hard disk 3A and the flash memory 3B, but also a central processing unit (CPU) 5, ROM (read-only memory) 6 storing a boot program and so on, a display device 7 comprising a LCD (liquid crystal display) or the like for displaying various operation screens and information, an operator unit 8 such as a keyboard and a mouse, an interface unit 9 (including the various music I/O section 25) for connecting and communicating with external equipments (including the music equipments 31-34), etc. Also, as well known, the CPU 5 and other above-mentioned sections 3A, 3B, 4, 6-9 in the personal computer PC are connected with each other via a bus section not shown in FIG. 28. Note that files containing programs such as the OS, DAW 2 (application software), various plug-in software, etc. are stored in predetermined folders on the hard disk 3A and/or the flash memory 3B, and the CPU 5 reads out these files from the corresponding folders as necessarily and executes processing based on the programs of the read-out files to thereby cause the personal computer PC function as the music processing apparatus 1.

When any one the externally-connected music equipments 31-34 has been disconnected from the music processing apparatus 1 by erroneous operation or by accident, the disconnected music equipment is converted into a dummy (or dummied) state such that it can no longer be used. In this case, the ports having so far been set for the disconnected music equipment are each converted into a dummy state, and operational data, such as parameter information, having so far been set in the disconnected music equipment are retained for subsequent use. Further, if the disconnected music equipment has so far been connected to the music LAN 30, connection information for building logical paths of the music LAN 30 is also retained for subsequent use. Then, once the disconnected music equipment is again connected (i.e., re-connected) to the music processing apparatus 1, not only the ports converted into the dummy state are restored to their previous operating states on the basis of the retained connection information, but also the operational data are transferred to the disconnected music equipment to restore the music equipment to the previous operating state.

Figure 2:
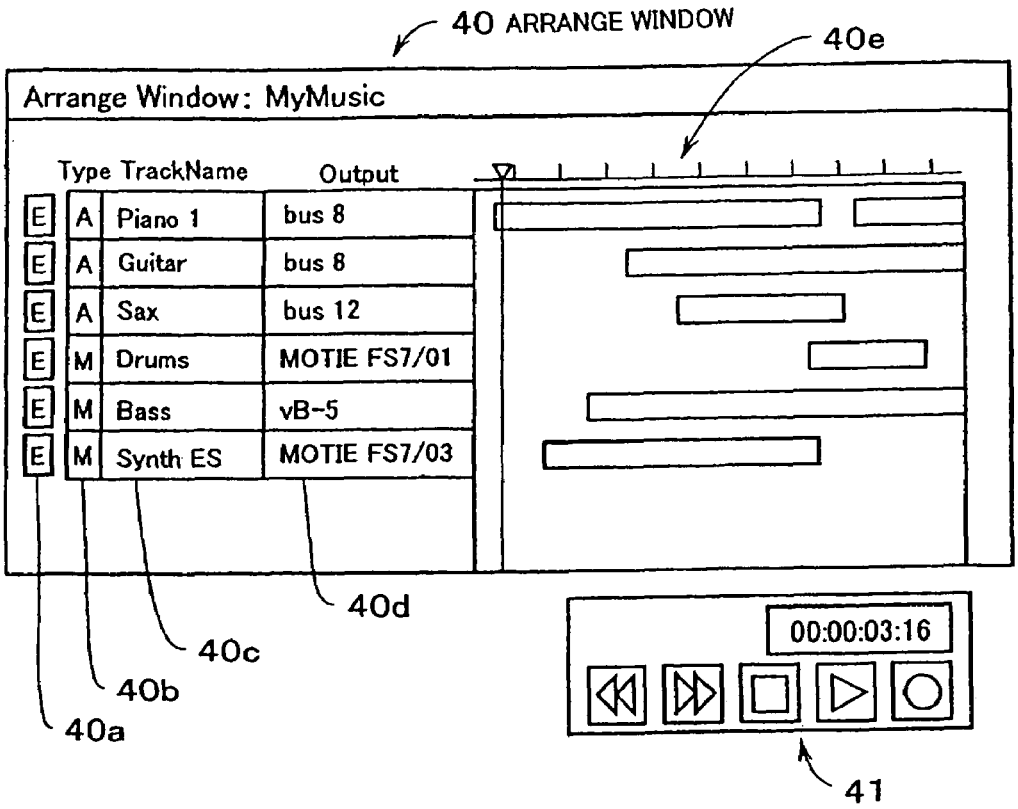
FIG. 2 is a diagram showing an arrange window displayed at the time of recording or reproduction in the music processing apparatus.
Figure 4:
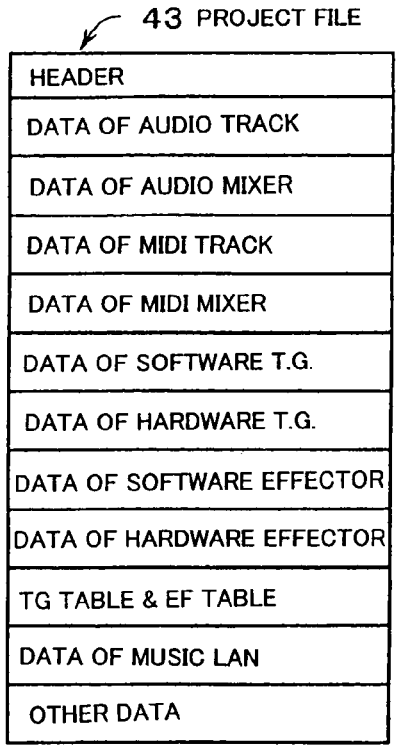
FIG. 4 is a diagram showing an example data format of a project file in the music processing apparatus of the present invention.

FIG. 2 shows an arrange window 40 displayed in the music processing apparatus 1 when recording or reproduction is to be performed. On the arrange window 40, there is displayed a project file of a file name "MyMusic". The project file is a file containing a complete set of data of a single music piece in the music processing apparatus 1. The project file is stored in an appropriate memory device such as the hard disk 3A or flash memory 3B in the personal computer PC of the music processing apparatus 1 as shown in FIG. 28. According to the processing of the OS and DAW 2 executed by the CPU 5, the music processing apparatus 1 can load the project file into a working memory area of the RAM 4, or save, into the memory device (3A or 3B), stored contents of the working memory as the project file. Example data format of the project file is illustrated in FIG. 4. As shown, the project file 43 includes: a header, data of the audio tracks (i.e., waveform data and management data of a plurality of audio tracks); data of the audio mixer (i.e., parameters of a plurality of channels); data of the MIDI tracks (sequence data of a plurality of MIDI tracks); data of the MIDI mixer (i.e., parameters of a plurality of channels); data of a software tone generator (i.e., parameters of an activated software tone generator); data of a hardware tone generator (i.e., parameters of a hardware tone generator registered in the tone generator rack); data of a software effector (i.e., parameters of an activated software effector); data of a hardware effector (i.e., parameters of an inserted hardware effector); TG (tone generator) table/EF (effector) table; data of the music LAN; and other data. In the header, information, such as the name, created date and size, of the project file is stored and managed. The TG table is a table storing equipment data including data indicative of the respective names of the music equipments 31-34 that are in the form of hardware tone generators externally connected to the music processing apparatus 1; correspondency or association between the hardware tone generators and the editors; numbers of the ports; correspondency or association between the hardware tone generators s and the ports; and the like. The EF table is a table storing equipment data including data indicative of the respective names of the music equipments 31-34 that are in the form of hardware effectors externally connected to the music processing apparatus 1; association between the hardware effectors and the editors; numbers of the ports; association between the hardware effectors and the ports; and the like. Further, the data of the music LAN is connection information indicative of logical connections between the music processing apparatus 1 and the music equipments 31-33 connected to the music processing apparatus 1 via the music LAN. The other data in the project file 43 include information of an equipment data library storing equipment data of a plurality of equipments set manually by the user, and the like.

On the arrange window 40, there are provided, for each of the tracks, a track type field 40*b* indicating the type of the track, a track name field 40*c* indicating a name of the track and an output destination field 40*d* indicating an output destination of the track, and an edit button 40*a* is displayed at the head of each of the tracks. In the track type fields 40*b*, the audio tracks are each indicated by "A" and the MIDI tracks are each indicated by "M". In the project file "MyMusic", the output destination of the audio track "Piano 1" is set to "bus 8", the output destination of the audio track "Guitar" is also set to "bus 8", the output destination of the audio track "Sax" is set to "bus 12". Further, the output destination of the MIDI track "Drums" is set to a first port of a hardware tone generator "MOTIE FS7", the output destination of the MIDI track "Bass" is set to a software tone generator "vB-5", and the output destination of the MIDI track "Synth ES" is set to a third port of the hardware tone generator "MOTIE FS7". Further, time-serial events of each of the tracks are displayed on an event display section 40*e*. By the user clicking or operating any of displayed operation buttons 41, it is possible to record onto and reproduce from any one of the tracks which has been selected on the arrange window 40 in response to operation of any of the operation buttons.

Figure 3:
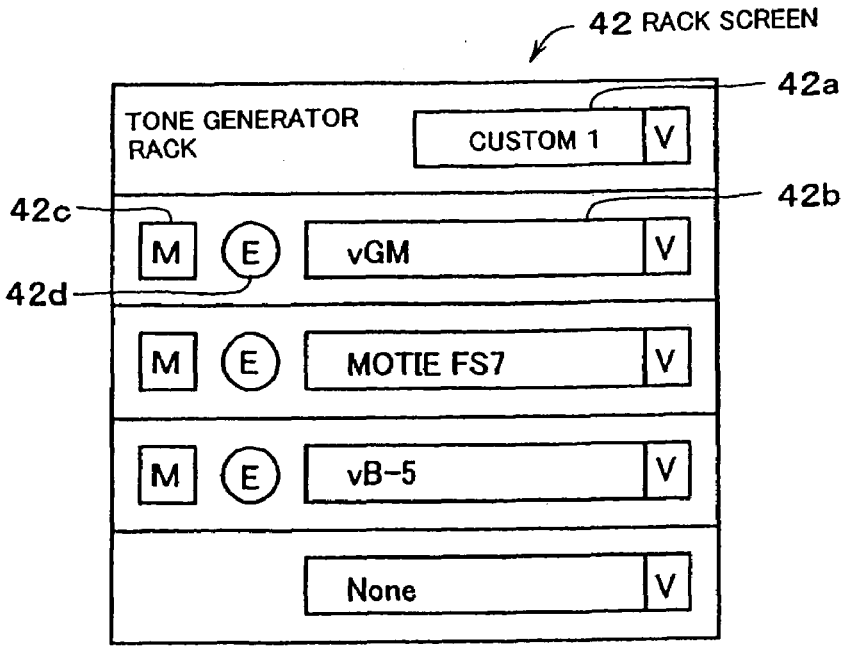
FIG. 3 is a diagram showing a rack screen indicating a tone generator rack registered when a plugged-in software tone generator and externally-connected hardware tone generator are to be used.

FIG. 3 shows a rack screen 42 of a tone generator rack that is a rack object registered when a plugged-in software tone generator or externally-connected hardware tone generator is to be used. As indicated by the rack screen 42, there are provided, in the tone generator rack, a mute button 42*c*, edit button 42*d* and tone generator name field 42*b*. On the tone generator rack of FIG. 3 which is assigned a tone generator rack name 42*a* of "Custom 1", for example, there are currently mounted a software tone generator named "vGM", hardware tone generator named "MOTIE FS7" and software tone generator named "vB-5". Once the software tone generator "vB-5" is registered into the tone generator rack, the program of the corresponding musical instrument plug-in software is executed so that a MIDI output port for supplying MIDI events from the music processing apparatus 1 to the software tone generator "vB-5" and an audio input port for outputting tones, generated by the software tone generator "vB-5", to the music processing apparatus 1 are created, so that the music processing apparatus 1 and the software tone generator "vB-5" will be logically connected with each other via the input/output ports. In this case, the name "vB-5" of the tone generator is automatically assigned to the MIDI output port and audio input port thus created. Thus, for any one of the MIDI tracks, for example, the user can designate a MIDI event output destination with the name "vB-5" of the tone generator. Further, by turning on the mute button 42*c* corresponding to the software tone generator "vB-5" in the tone generator rack, it is possible to mute an audio signal supplied from the software tone generator "vB-5" via the audio input port. Also, by clicking the edit button 42*d*, an editing screen of the software tone generator "vB-5" is opened so that any of tone color parameters and tone generator parameters of the software tone generator "vB-5" can be edited.

Then, a mixer screen is opened or displayed with an audio channel strip added thereto in correspondence with the software tone generator "vB-5". In the added audio channel strip, it is possible to set input/output routing of the audio channel and insertion, in the audio channel, of a software effector or hardware effector. The audio channel strip includes mute and pan operators and fader, as well as a level meter. On a pop-up menu opened when the input/output routing is to be set, selectable input and output ports are displayed with tone generator names, track names and bus names assigned thereto, so that the intended routing can be set with ease.

In the case where the tone generator "MOTIE FS7" is a MIDI hardware tone generator externally connected to the music processing apparatus 1, the music processing apparatus 1 inquires of the tone generator "MOTIE FS7" upon completion of external connection to the processing apparatus 1 and thereby generates equipment data of the tone generator section of the hardware tone generator "MOTIE FS7" to store the generated equipment data into an equipment data library. Then, once the equipment data of the hardware tone generator "MOTIE FS7" is selected from the equipment data library and then registered for use in the music processing apparatus 1, the equipment data of the tone generator is moved from the equipment data library to the TG table so that the hardware tone generator "MOTIE FS7" can be registered into the tone generator rack. Then, upon completion of the registration of the hardware tone generator into the tone generator rack, the mixer screen is opened with an audio channel strip added thereto in correspondence with the hardware tone generator. Because the instant embodiment is arranged in such a manner that, for each hardware tone generator registered in the tone generator rack, port names are replaced on the basis of the corresponding equipment data in the TG table, the names of the MIDI output port and audio input port corresponding to the hardware tone generator "MOTIE FS7" are each replaced with the name "MOTIE FS7" of the tone generator. Further, according to the instant embodiment, each tone generator registered in the tone generator rack is associated with any one of the editors on the basis of the corresponding equipment data stored in the TG table; thus, an editing screen of the editor associated with the hardware tone generator "MOTIE FS7" is opened by the user clicking the edit button 42*d* corresponding to the hardware tone generator "MOTIE FS7" in the tone generator rack, so that the user can edit tone color parameters and tone generator parameters of the hardware tone generator "MOTIE FS7" on the editing screen.

Figure 5:
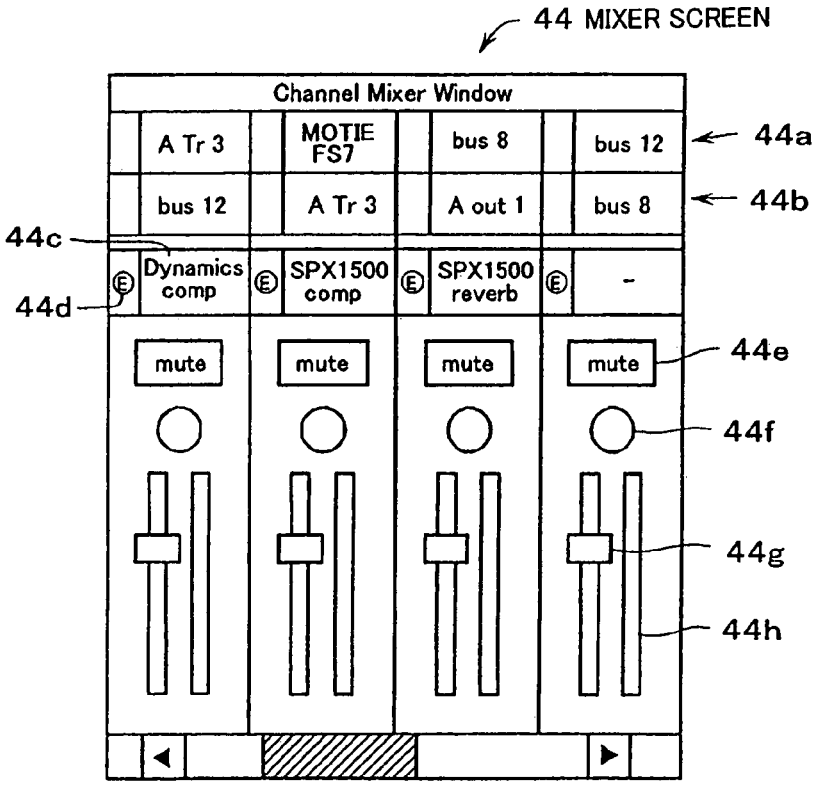
FIG. 5 is a diagram showing shows a mixer screen in the music processing apparatus of the present invention.

FIG. 5 shows an example of the mixer screen 44. On the mixer screen 44 of FIG. 5, it is possible for the user to set, per audio channel strip, input/output routing of the audio channel and insertion, in the audio channel, of a software effector or hardware effector. The audio channel strip includes mute and pan operators 44*e* and 44*f* and fader 44*g*, as well as a level meter 44*h*. On a pop-up menu opened when the input/output routing is to be set, the user can select from a menu of input or output ports assigned tone generator names, track names and bus names, so that the input/output routing can be set with ease.

In the second audio channel strip from the left on the mixer screen 44, an input 44*a* is set at "MOTIE FS7", and an output 44*b* is set at "A Tr 3". Namely, it can be seen that an audio signal (tone) generated by the hardware tone generator "MOTIE FS7" is input to the audio channel via the audio input port set for the hardware tone generator "MOTIE FS7" and then the audio channel is output from the audio channel to the third audio track (A Tr 3). Further, an effector 44*c* named "SPX1500 comp", i.e. compressor "SPX1500", is inserted in this audio channel. As known in the art, the compressor is an effector for decreasing a tone volume at a preset rate when the tone volume has exceeded a preset threshold value. Effect parameters of this effector can be edited by the user operating a corresponding edit button 44*d*, displayed to the left of the effector name, to open an editing screen of the effector.

Figure 6:
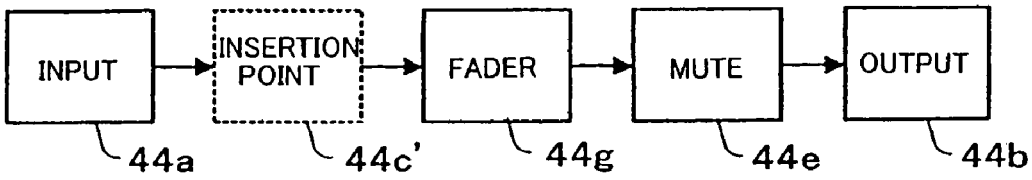
FIG. 6 is a block diagram showing an insertion point where an effector is to be inserted in an audio channel in the music processing apparatus of the present invention.

FIG. 6 shows an insertion point where the effector 44*c* is to be inserted in the audio channel. The effector 44*c* is inserted at the insertion point 44*c*' between the input 44*a* and fader 44*g* through an insertion process. Namely, an audio signal input via the input 44*a* is imparted with an effect by the effector 44*c* and then output to the fader 44*g*. The audio signal adjusted by the fader 44*g* to a predetermined level is passed via the mute 44*e* to the output 44*b*. The audio signal can be muted by the user operating the mute button 44*b* provided in the audio channel strip. Current output level in the audio channel is displayed by the level meter 44*h*.

Throughout this specification, the terms "set for use" are used in the context of the present invention to mean registering a tone generator in the tone generator rack or inserting an effector in an audio channel strip, while the terms "registered for use" are used in the context of the present invention to mean registering a hardware tone generator in the TG table or registering a hardware effector in the EF table.

Figure 7:
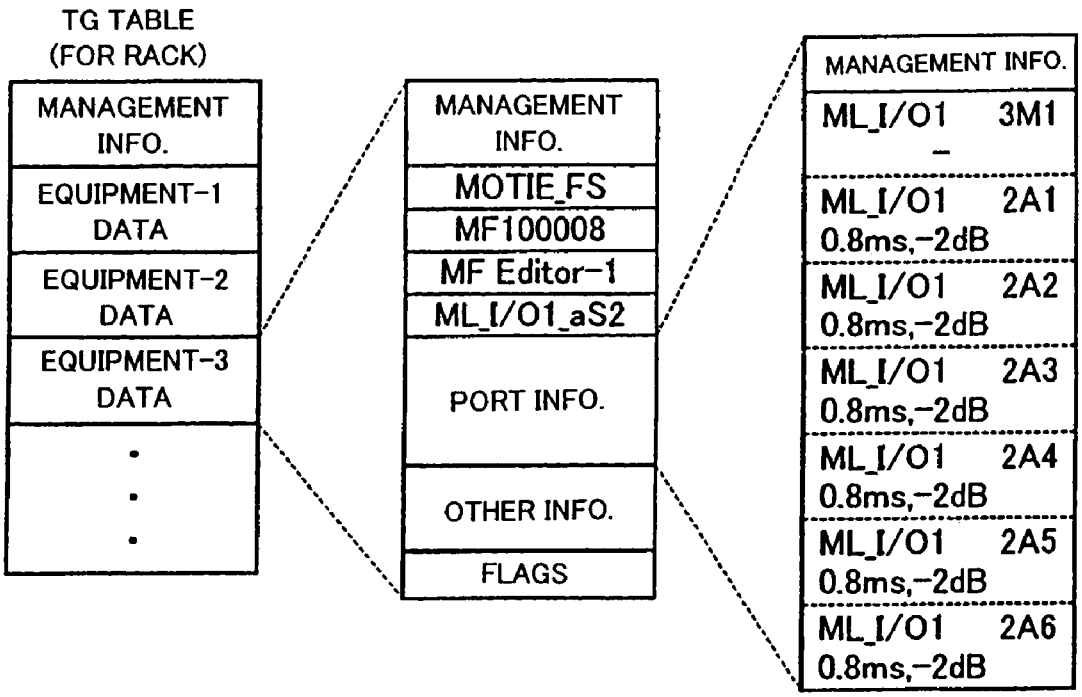
FIG. 7 is a diagram showing an example data structure of a TG table in the music processing apparatus of the present invention.

FIG. 7 shows an example data structure in the TG table that manages information of hardware tone generators. In the TG table, there can be registered equipment data of each music equipment (hardware tone generator) manually added by the user, as well as equipment data of each music equipment (hardware tone generator) currently registered in the TG library.

As seen in FIG. 7, the TG table contains management information indicative of a data size of the TG table, number of music equipments to be managed, etc., and equipment data of the individual music equipments, i.e. "equipment-1 data", "equipment-2 data", "equipment-3 data", etc. The equipment data of the individual music equipments are of a similar structure; FIG. 7 representatively shows details of the data structure of "equipment-3 data". As seen in FIG. 7, "equipment-3 data" includes: management information indicative of a data size of the equipment data, number of I/O devices, etc.; equipment name (in this case, "MOTIE_FS") or equipment ID (identification); equipment serial number (in this case, "MF1000008"), editor association information indicative of a program or instance of an associated editor (in this case, "ML Editor-1"; control port information identifying a control port (in this case, "ML_I/O_aS2"); control port information indicative of ports for communicating a MIDI event and audio signal; and other information and flags. Here, the equipment serial number is information for identifying the music equipment when a plurality of music equipments of a same type have been externally connected to the music processing apparatus 1, and the editor association information is link information designating an editor (remote control software) for editing parameters of the music equipment and capable of associating the music equipment with an instance of one editor even when a plurality of editors of a same type are activated. The control port information is information indicative of a port via which the remote control section (activated remote control software) 14 communicates with the music equipment through serial communication. Various parameters and the like of the music equipment are set via the control port; note that the control port may be a MIDI input/output port instead of being limited to a serial port. The flags indicate, for example, information as to whether or not the music equipment is currently being used, and information as to whether or not the current operating state is a normal operating state or a dummy operating state. Further, the aforementioned other information includes information indicative of a delay characteristic and gain characteristic of each of the I/O devices.

The aforementioned port information comprises management information and port-specific information, and details of a data structure of the port-specific information is shown in FIG. 7. As shown, the port-specific information includes: management information managing a data size, numbers of MIDI output ports and audio input ports, audio channel structure, etc.; I/O device information; I/O port information; and port-specific information indicative of a delay and return gain. In the illustrated example of FIG. 7, information designating one MIDI port of the music processing apparatus 1 and audio input ports for 5.1-channel-supporting six channels is set for communication with the equipment "MOTIE FS". Logical I/O port "3M1" of an I/O device "ML_I/O1" of the music LAN is designated as the MIDI output port (MIDI_out1), and no other parameter is set for this output port. More specifically, in the illustrated example, six logical I/O ports, "2A1", "2A2", "2A3", "2A4", "2A5" and "2A6", are designated as the audio input ports for six channels (Audio_inL, Audio_inR, Audio_inC, Audio_inLs, Audio_inRs and Audio_inLE), and a 0.8 ms delay and −2 dB return gain are set as parameters of each of the audio input ports. The "delay" is a delay time from a time of supply, to the equipment "MOTIE_FS", of a MIDI event to a time of output of a corresponding audio signal, and the DAW 2 has a function of outputting a MIDI event, to be supplied to the equipment "MOTIE_FS", earlier than the time so as to compensate for the delay. The logical I/O port "3M1" is a port formed logically, within the music processing apparatus 1, as a MIDI output port for outputting MIDI events to the music equipment connected to the music LAN, and it is recognized or identified as a MIDI output port when information of the port "3M1" has been read. Further, the I/O ports "2A1"-"2A6" are ports provided for the audio input ports and identified as audio input ports when information of the logical I/O ports "2A1"-"2A6" has been read. Note that the EF table, similar in structure to the TG table, is created for management of the hardware effectors.

Figure 8:
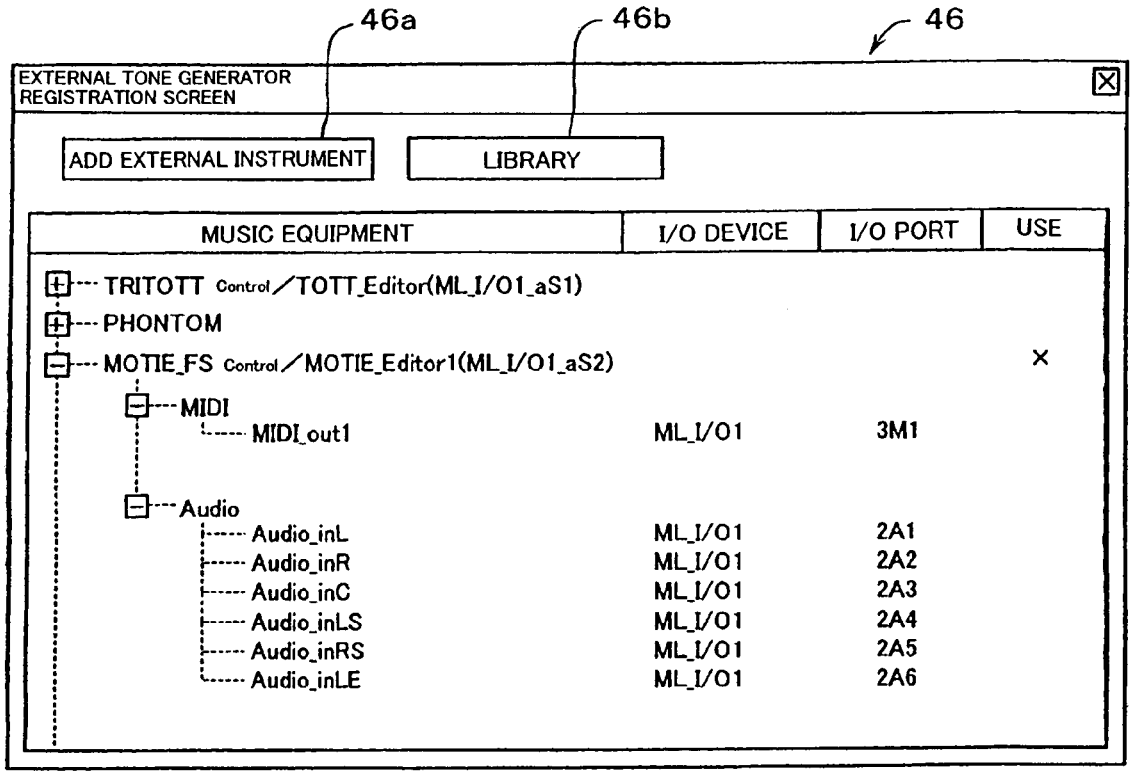
FIG. 8 is a diagram showing an external tone generator registration screen in the music processing apparatus of the present invention.

FIG. 8 shows an external tone generator registration screen for registering equipment data of music equipments (hardware tone generators) in the TG table. On the external tone generator registration screen 46 illustrated in FIG. 8, there are provided an "add external instrument" button 46*a* and a "library" button 46*b*. When a hardware tone generator is to be manually added and registered, the user opens an additional registration dialog by operating the "add external instrument" button 46*a*, via which the user can add, to the TG table, items for setting necessary information of the hardware tone generator and manually enter data per added item. Further, when equipment data of a music equipment (hardware tone generator) is to be registered into the TG table from the library (namely, "equipment data library"), the user operates the "library" button 46*b*, so that a selection menu for selecting the equipment data of the music equipment currently registered in the library is opened and thus the user is allowed to select the desired music equipment (hardware tone generator) from the menu and register the selected music equipment into the TG table. Note that the library contains equipment data of each music equipment (hardware tone generator) bookmarked or registered as a user's favorite and equipment data of each music equipment (hardware tone generator) automatically registered as the equipment was connected to the music processing apparatus 1 via the music LAN. Through the registration into the TG table, the equipment data of the thus-registered music equipment (hardware tone generator) is added to a list of music equipments of the external tone generator registration screen and displayed on the screen.

The list indicated on the external tone generator registration screen indicates, as equipment data of the music equipments (hardware tone generators) registered in the TG table, names of the music equipments, information of I/O devices and I/O ports connected to the music equipments (e.g., port-identifying information), information indicative of editors for controlling the music equipments and control ports therefor, and flags indicating whether or not the music equipments are currently being used. On the external tone generator registration screens 46 illustratively shown FIG. 8, there are registered, as the names of the music equipments (hardware tone generators), "TRITOTT", "PHONTOM" and "MOTIE_FS". "TOTT_Editor" of "Control/TOTT_Editor(ML_I/O1_aS1)" displayed following the hardware tone generator name "TRITOTT" is information designating remote control software (editor) that is activated when parameter editing and setting is to be performed with the hardware tone generator "TRITOTT" remote-controlled. Further, "ML_I/O1_aS1" indicates a serial port (S1) in an asynchronous channel (a) of an I/O device (ML_I/O1) of the music LAN (e.g., mLAN (registered trademark)). Namely, the hardware tone generator "TRITOTT" is connected to the music LAN 30. "Control/MOTIE_Editor(ML_I/O1_aS2)" displayed following the hardware tone generator name "MOTIE_FS" is similar to "Control/TOTT_Editor(ML_I/O1_aS1)", and "MOTIE_Editor" designated as remote control software is activated when parameter editing and setting is to be performed with the hardware tone generator "MOTIE_FS" remote-controlled. Further, "ML_I/O1_aS2" indicates a serial port (S2) in the asynchronous channel (a) of the I/O device (ML_I/O1) of the music LAN (e.g., mLAN (registered trademark)). Namely, the hardware tone generator "MOTIE_FS" too is connected to the music LAN 30. For the hardware effectors as well, an external effector registration screen for registering the equipment data of the music equipments (hardware effectors) in the EF table; the external tone generator registration screen is similar in instruction to the external effector registration screen. The equipment data of the music equipments (hardware effectors) are registered in response to user's operation similar to the aforementioned.

On the external tone generator registration screen 46 illustratively shown in FIG. 8, a hierarchical structure of the hardware tone generator "MOTIE_FS" is displayed in an expanded form. On a hierarchical level immediately below the highest hierarchical level, there are shown structures of the MIDI I/O port and audio I/O ports, i.e. one MIDI output port (MIDI_out1) and six audio input ports (Audio_inL, Audio_inR, Audio_inC, Audio_inLs, Audio_inRs and Audio_inLE), provided for the hardware tone generator "MOTIE_FS". In display areas of these ports, I/O device and I/O port displays are given on the basis of the equipment data of the hardware tone generator "MOTIE_FS" shown in FIG. 7. In response to user's operation on the external tone generator registration screen 46, editing is performed on the equipment data of any one of the music equipment stored in the TG table. Each hardware tone generator having its equipment data registered in the TG table is displayed on and selectable from a TG selection menu of the tone generator rack. Each hardware tone generator placed in the dummy (dummied) state is displayed in a grey (or halftone) display style, on the TG selection menu of the tone generator rack, so that it can not be selected by the user. Once the hardware tone generator is selected from the TG selection menu and registered, a mark "×" is displayed on a "use" field of the external tone generator registration screen 46, and the flag of the TG table is switched to a state to indicate that the hardware tone generator is currently in use. Further, the name of the hardware tone generator is deleted from the TG selection menu of the tone generator rack, to be no longer displayed for selection. In this manner, two hardware tone generators are prevented from being registered concurrently in the tone generator rack. However, software tone generators, which are managed separately from the TG table, can be displayed on the TG selection menu even though registered once, so that a plurality of software tone generators can be registered concurrently in the tone generator rack.

Figure 9:
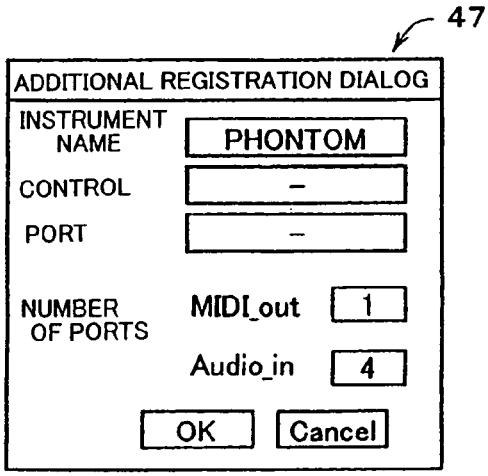
FIG. 9 is a diagram showing a screen of an additional registration dialog displayed when an external tone generator is to be added to the music processing apparatus of the present invention.

FIG. 9 shows a screen of an additional registration dialog 47 opened in response to user's operation of the "add external instrument" button 46*a*. On the additional registration dialog 47 illustratively shown in the figure, the name "PHONTOM" of a hardware tone generator to be added has been input to an "instrument name" input field. Further, as the number of the ports of the hardware tone generator "PHONTOM", "1" has been input to a MIDI output port (MIDI_out) input field, and "4" has been input to an audio input port (Audio_in) input field. Furthermore, the name of the remote control software can be input to a "control" input field, and a port to be used for the remote control can be input to a "port" input field. When the equipment data of the hardware tone generator is to be added to the TG table on the basis of the data input to the individual input fields, the user operates an "OK" button. Thus, the equipment data of the hardware tone generator "PHONTOM" is added to the TG table, so that corresponding items are displayed on the external tone generator registration screen 46. At that time, items, such as port information indicative of the individual MIDI/audio input and output ports, have not yet been set and are left blank, and thus, the user has to manually set these items sequentially. In case the equipment data of the hardware tone generator is not to be added to the TG table, the user only has to operate a "Cancel" button.

Now, a description will be given about the libraries ("equipment data libraries"), which comprise the TG library having hardware tone generators registered therein and the EF library having hardware effector registered therein. In the TG library, there are registered equipment data of each music equipment (hardware tone generator) bookmarked or registered as a user's favorite and equipment data of each music equipment (hardware tone generator) automatically registered as the music equipment was connected to the music processing apparatus 1 via the music LAN. The user can select the equipment data of any desired one of the hardware tone generators from the TG library and register the selected equipment data into the TG table. Further, when any one the music equipments has been disconnected from the music processing apparatus 1 in response to user's disconnecting operation or by erroneous operation or accident, the equipment data of the disconnected music equipment (hardware tone generator) is deleted from the TG library. As noted above, when any hardware tone generator already registered in the tone generator rack has been disconnected from the music processing apparatus 1, the registration of the disconnected music equipment (hardware tone generator) is placed in the "dummy" state with setting data, such as parameters, of the music equipment (hardware tone generator) kept retained in the parameter memory (i.e., the working memory area of the RAM 4 or a predetermined working area on the hard disk 3A or flash memory 3B in FIG. 28) in the music processing apparatus 1. Then, once the disconnected music equipment (hardware tone generator) is again connected (re-connected) to the music processing apparatus 1, not only the retained setting data are transferred to and automatically set in the hardware tone generator, but also the hardware tone generator is released from the dummy state and placed in the normal operating state. Similar processing is performed on the EF library such that the equipment data of any desired music equipment (hardware effector) can be registered into the EF table. Further, the music equipments registered in the EF table can be displayed on an EF selection menu so that any effector to be inserted in an audio channel strip can be selected from the EF selection menu.

In the EF library, there are registered equipment data of each music equipment (hardware effector) bookmarked or registered as a user's favorite and equipment data of each music equipment (hardware effector) automatically registered as the equipment was connected to the music processing apparatus 1 via the music LAN. The user can select the equipment data of any desired hardware effector from the EF library and register the selected equipment data into the EF table. The hardware effector thus registered in the EF table is displayed on the EF selection menu and can be inserted in a desired audio channel strip. Further, when any one of the music equipments (hardware effectors) has been disconnected from the music processing apparatus 1 in response to user's disconnecting operation or by erroneous operation or accident, the equipment data of the disconnected music equipment (hardware effector) is deleted from the EF library. If any hardware effector inserted in an audio channel strip has been disconnected from the music processing apparatus 1, the disconnected music equipment (hardware effector) is placed in the "dummy" state, but setting data, such as parameters, of the music equipment (hardware effector) are kept retained in the parameter memory (i.e., the working memory area of the RAM 4 or the predetermined working area on the hard disk 3A or flash memory 3B in FIG. 28) in the music processing apparatus 1. Then, once the disconnected hardware effector is again connected to the music processing apparatus 1, not only the retained setting data are transferred to and automatically set in the hardware effector, but also the hardware effector is released from the dummy state and placed in the normal operating state.

Figure 10:
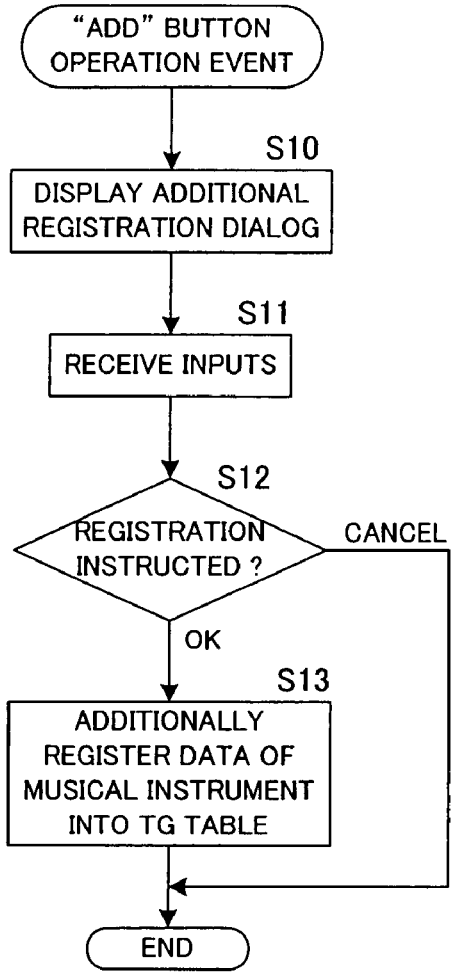
FIG. 10 is a flow chart of an "add" button operation event process performed in the music processing apparatus of the present invention.

FIG. 10 is a flow chart of an "add" button operation event process that is started up in response to user's operation of the "add external instrument" button 46*a* on the external tone generator registration screen 46 shown in FIG. 8.

Once the "add" button operation event process is started up, the additional registration dialog shown in FIG. 9 is opened and displayed at step S10. At following step S11, inputs to the "instrument name" input field, "control" input field, MIDI output port (MIDI_out) input field and audio input port (Audio_in) input field are received. At next step S12, a determination is made as to whether or not a registration instruction has been given. If the "OK" button has been operated, it is determined at step S12 that a registration instruction has been given and the equipment data of the hardware tone generator (musical instrument) is additionally registered, at step S13, into the TG table of FIG. 7, after which the "add" button operation event process is brought to an end. If, on the other hand, a "Cancel" button has been operated, it is determined at step S12 that no registration instruction has been given, so that the "add" button operation event process is brought to an end without performing the operation of step S13.

Although a port storage region is created for storing the port information of the music equipment (hardware tone generator) added through the aforementioned "add" button operation event process, the port information has no individual port designated therein, and I/O port fields for displaying individual ports are left blank. Thus, the user has to sequentially designate I/O ports and set the designation of the I/O ports by sequentially clicking the blank I/O port fields. Note that, at that time, the added music equipment (hardware tone generator) has not yet been registered in the tone generator rack. In the case where the music equipment is a hardware effector, it is displayed on the EF selection menu of an audio channel strip when it has been registered in the EF table; however, because designation of individual ports has not yet been set at that time, connection to and from the insertion point is not permitted even though the hardware effector has been inserted.

In a condition that the DAW 2 is activated in the personal computer PC to cause the personal computer PC function as the music processing apparatus 1, as any operation event or processing command is generated in response to an operation to the screen via the operation unit 8 (e.g., the mouse, etc.) or detection of connection with the external equipments through the interface unit 9 (including the various music I/O section 25), a necessary processing routine composing a part of the DAW 2 and corresponding to the generated operation event or processing command is activated, and then the personal computer PC executes various processing in response to the operation to the screen or the detection of connection with the external equipments. Next, some important event-corresponding processing routines and command processing routines will be described hereinbelow.

Figure 12:
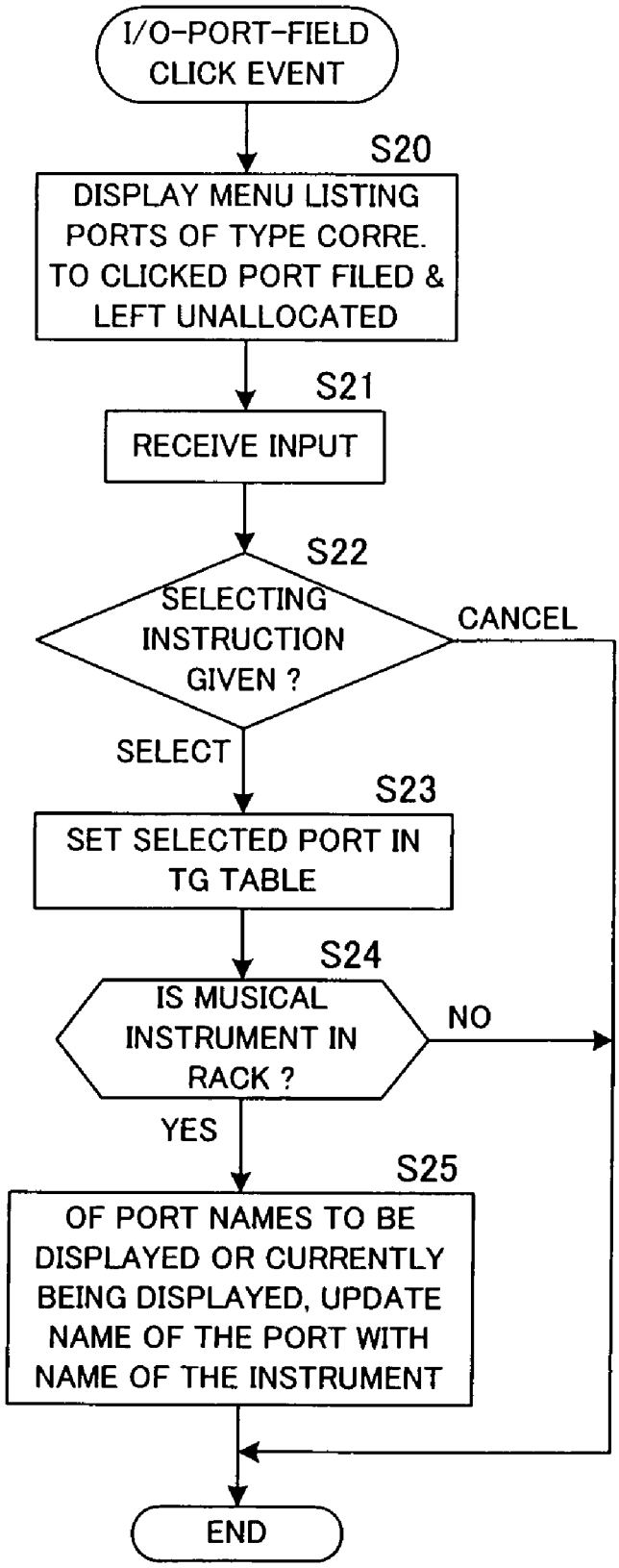
FIG. 12 is a flow chart of an I/O-port-field click event process performed in the music processing apparatus of the present invention.

FIG. 12 is a flow chart of an I/O-port-field click event process that is started up in response to user's operation of the I/O port field of a desired music equipment (musical instrument) on the external tone generator registration screen or TG table.

Once the I/O port field of a desired music equipment (musical instrument) is clicked on the external tone generator registration screen, this I/O-port-field click event process is started up. First, at step S20, a menu is displayed which lists ports of a type corresponding to the clicked I/O port field and left unallocated among the ports of the I/O devices of the music processing apparatus 1. Input by user's selecting operation is received at next step S21, and a determination is made, at step S22, as to whether an instruction has been given for selecting any one of the ports displayed on the menu. If an instruction has been given for selecting any one of the displayed ports as determined at step S22, the process goes on to step S23, where information designating the selected port is written into the equipment data of that equipment in the TG table. Then, a determination is made, at step S24, as to whether the music equipment (musical instrument), whose I/O port field has been clicked, has already been registered in the tone generator rack. If answered in the affirmative at step S24, the process goes to step S25, where the name of the selected port from among those to be displayed or currently being displayed is updated with the port name of the music equipment (musical instrument) in question. After completion of the operation of step S25, or if no selecting instruction has been given (e.g. by the user clicking an area other than the menu) as determined at step S22, the instant click event process is brought to an end. In the above-described manner, designation of one port is set each time the click event process is carried out.

In the case where the music equipment is an effector, the effector is displayed on the EF selection menu of a given audio channel strip when it has been registered into the EF table, so that it can be selected and inserted as desired by the user. Thus, at step S24, a determination is made as to whether the effector in question has been inserted in any channel strip. With an affirmative determination at step S24, connection to a designated port is set at the insertion point. Further, in the case where the music equipment is an effector, the port name to be updated at step S25 is set to the name of the effector, and this effector name is displayed in an "effector selection menu" for selecting effects to be inserted in individual audio channels of the audio mixer and displayed in the setting section that sets insertion of effectors in individual audio channels.

Figure 11:
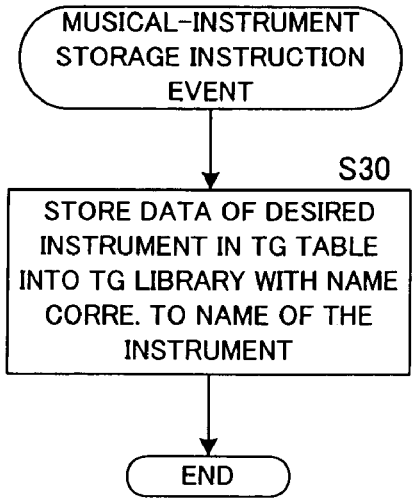
FIG. 11 is a flow chart of a musical-instrument storage instruction event process performed in the music processing apparatus of the present invention.

FIG. 11 is a flow chart of a musical-instrument storage instruction event process that is started up when a selection has been made, on a menu displayed for example in response to right-clicking of the mouse, for storing a desired musical instrument into the TG library.

Once the musical-instrument storage instruction event process on a desired musical instrument is started up, the equipment data of the desired music equipment (musical instrument) in the TG table is stored, at step S30, into the TG library as a user's favorite music equipment (musical instrument) with a name corresponding to the name of the music equipment (musical instrument). Where the music equipment is an effector, the equipment data of the music equipment (effector) in the EF table is stored, in response to a storage instruction, into the EF library as a user's favorite music equipment (effector) under a name corresponding to the name of the music equipment (effector).

Figure 13:
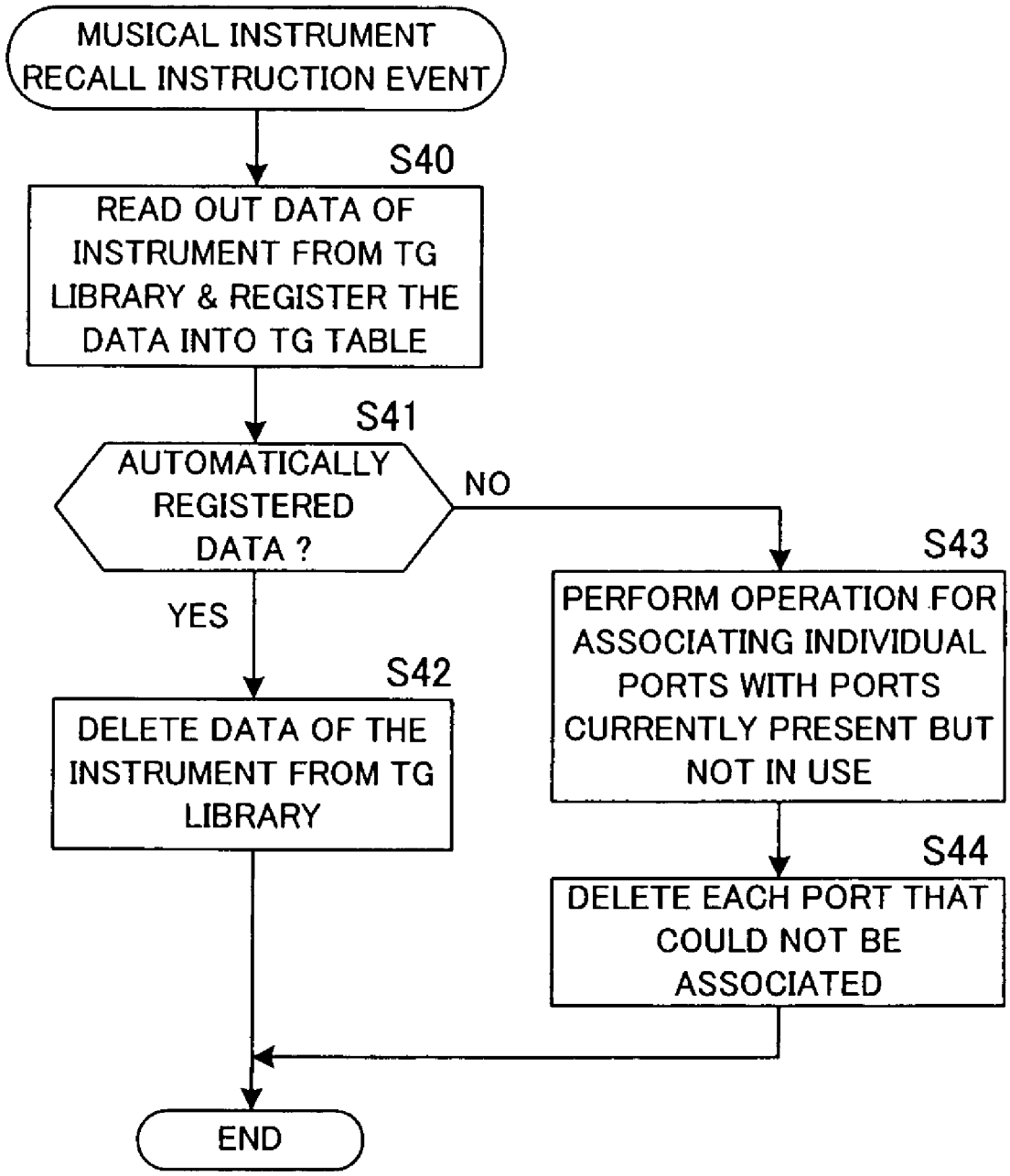
FIG. 13 is a flow chart of a musical-instrument recall instruction event process performed in the music processing apparatus of the present invention.

FIG. 13 is a flow chart of a musical-instrument recall instruction event process that is started up when a selection has been made, on a menu displayed for example in response to right-clicking of the mouse, for recalling a desired musical instrument from the TG library.

Once the musical-instrument recall instruction event process on a desired musical instrument is started up, the equipment data of the desired music equipment (musical instrument), for which the recall instruction has been given, is read out from the TG library and registered into the TG table. Then, at step S41, a determination is made as to whether the registered equipment data is equipment data of a music equipment (musical instrument) that was automatically registered in the TG library. With an affirmative determination at step S41, the process proceeds to step S42 to delete the music equipment (musical instrument), so far registered in the TG library, along with the equipment data, because only one music equipment (musical instrument) automatically registered in the TG library is registerable. If, on the other hand, the registered equipment data is not equipment data of a music equipment (musical instrument) that was automatically registered in the TG library, the process branches to step S43. Note that the music equipment (musical instrument) might be one that was registered manually in the TG library by the user and individual ports of the music equipment might be already in use. Thus, at step S43, an operation is performed for associating individual ports in the equipment data in question, registered in the TG table, with ports that are currently present but not currently in use. At following step S44, each port that could not be associated is deleted. After completion of the operation of step S42 or S44, the musical-instrument recall instruction event process on the desired musical instrument is brought to an end.

Figure 14:
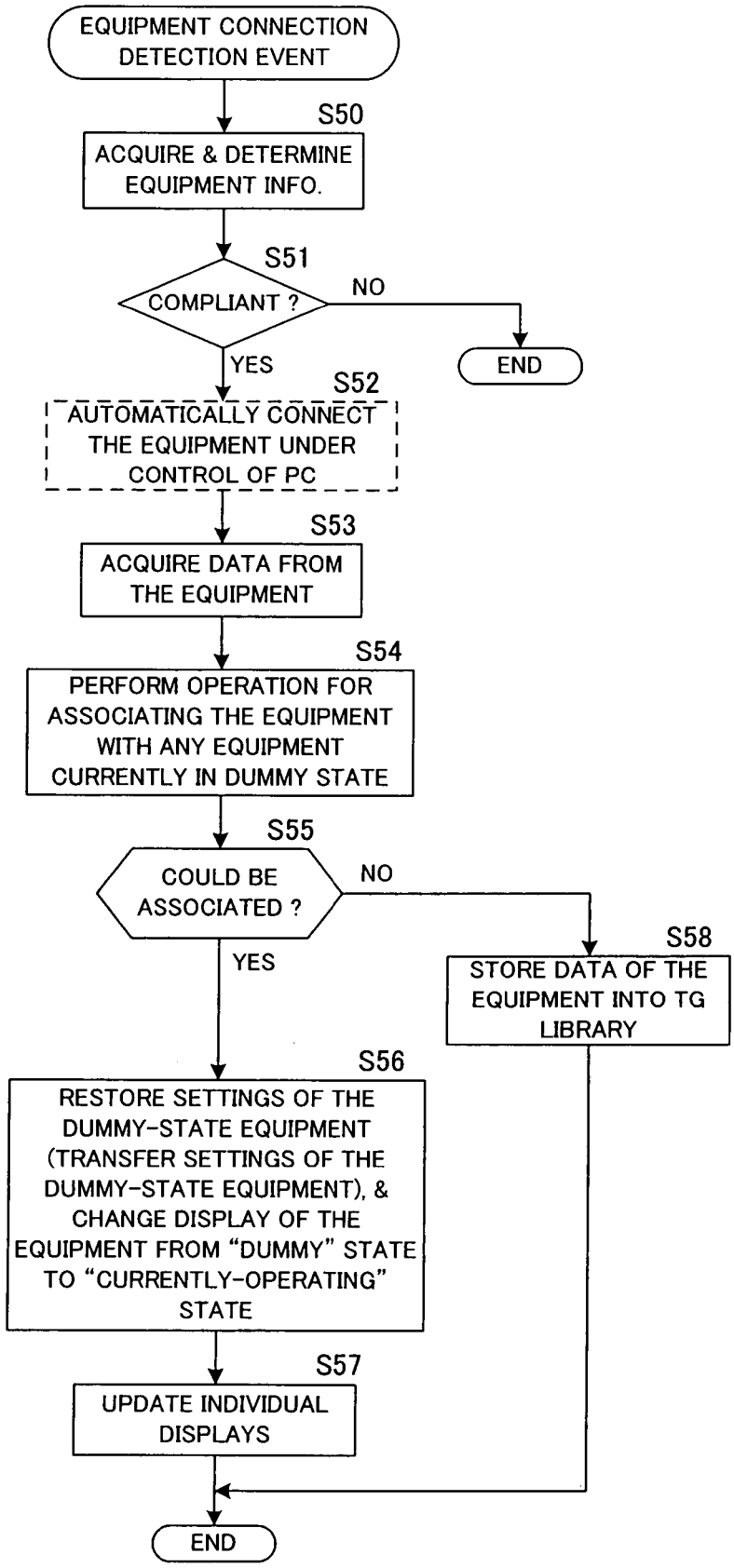
FIG. 14 is a flow chart of an equipment connection detection event process performed in the music processing apparatus of the present invention.

FIG. 14 is a flow chart of an equipment connection detection event process that is started up at a predetermined frequency. Once the equipment connection detection event process is started, the process goes to step S50, where equipment information, such as the equipment ID, of a music equipment having been detected as newly connected to the music LAN, is acquired and then a determination is made as to whether the detected music equipment is a hardware tone generator or a hardware effector. Then, at step S51, a further determination is made as to whether or not the detected music equipment is compliant with plug-in and play functions of the music processing apparatus 1. If answered in the negative at step S51, it means that the detected music equipment can not be automatically connected to the music processing apparatus 1, and thus, the instant event process is brought to an end. If answered in the affirmative at step S51, on the other hand, the detected music equipment is automatically connected, at step S52, to the music processing apparatus 1 under control of the personal computer implementing the music processing apparatus 1. However, if the detected music equipment has an mLAN interface, it means that logical connections have already been established through the mLAN function during the automatic connection to the music processing apparatus 1; thus, in this case, the operation of step S52 need not be carried out.

Then, at step S53, the remote control section 14 inquires of the detected music equipment through a serial communication path, to acquire the equipment name and various data of device I/Os and I/O ports of the MIDI ports and audio ports and then create equipment data of the detected music equipment. Then, at step S54, an operation is performed for associating the detected music equipment with any music equipment currently displayed in the dummy state. At following step S55, a determination is made as to whether the detected music equipment could be associated with any music equipment currently displayed in the dummy state. If the detected music equipment could be associated with (i.e., corresponds to) any one of the music equipments currently displayed in the dummy state as determined at step S55, parameters of the music equipment currently in the dummy state are read out from the parameter memory (i.e., the working memory area of the RAM 4 or the predetermined working area on the hard disk 3A or flash memory 3B in FIG. 28) and transferred to the detected music equipment to reproduce or restore the settings of the dummy-state music equipment, at step S56. Further, the display of the dummy-state music equipment is change from the dummy state to the currently-operating state (or normal state). Thus, the detected music equipment is now capable of being remote-controlled via the corresponding editor so that editing of the parameters is permitted. Regardless of whether in the currently-operating state or in the dummy state, the editor, corresponding to the music equipment (hardware tone generator) registered in the tone generator rack or the music equipment (hardware effector) inserted in an audio channel strip, has already been activated if the music equipment in question could be associated with the editor, and the parameters for controlling the behavior of these music equipment have already been stored in the music processing apparatus 1 (e.g., in the working memory area of the RAM 4 in FIG. 28). Then, at the time of switching from the dummy state to the currently-operating state (normal state), the remote control is performed with the aforementioned parameters stored in the music processing apparatus 1 and the parameters in the music equipment in question automatically synchronized with each other.

Then, at step S57, the display of the music equipment in question in the TG or EF table, having so far been in the grey display style, and the display of the currently-set ports are restored to their previous states. Here, what is placed in the dummy state is music equipment that has been set for use in the music processing apparatus 1 but is not currently connected to the music processing apparatus 1. Thus, in the case where the music equipment in question is a hardware tone generator and hence currently registered in the tone generator rack, and if the music equipment is currently in the dummy state, it means that the music equipment is currently being displayed in the grey display style in the tone generator rack, and thus, the grey display is also restored to the previous states. On the other hand, in the case where the music equipment in question is a hardware effector and hence inserted in an audio channel strip, the display of the effector in the audio channel strip is also in the grey display style, and thus, the grey display of the effector is also restored to the previous states. Further, if the detected music equipment does not correspond to any one of the music equipments currently placed in the dummy state as determined at step S55, it means that the detected music equipment is a music equipment that has been connected to the music processing apparatus 1 without being duly set for use in the music processing apparatus 1, and thus, the instant process branches to step S58, where the equipment data of the detected music equipment is stored into the TG library if the detected music equipment is a hardware tone generator, but stored into the EF library if the detected music equipment is a hardware effector. After completion of the operation of step S57 or step S58, the equipment connection detection event process is brought to an end. Namely, the automatic registration, into the TG library or EF library, of the music equipment having been detected as newly connected to the music LAN is carried out only when the detected music equipment could not be associated with any one of the music equipments currently placed in the dummy state.

Figure 15:
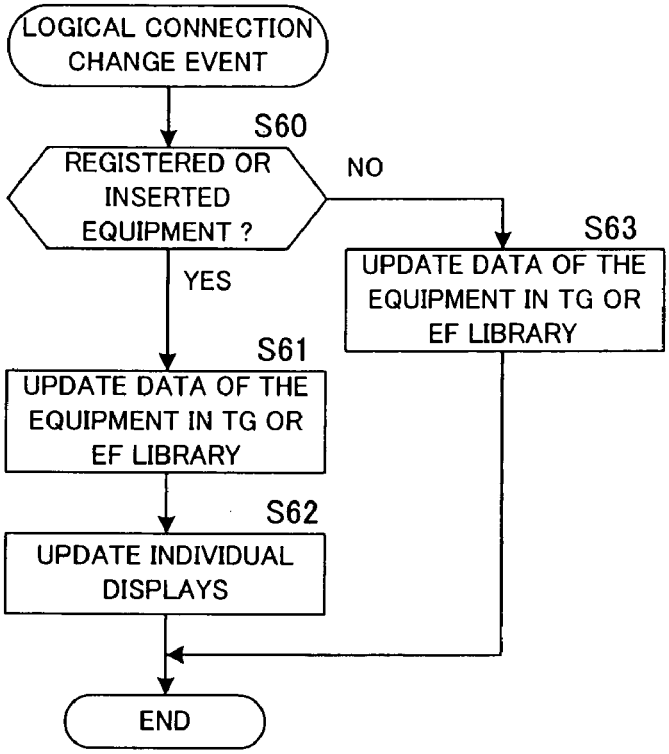
FIG. 15 is a flow chart of a logical connection change event process performed in the music processing apparatus of the present invention.

FIG. 15 is a flow chart of a logical connection change event process that is started up in response to occurrence of a connection change event on a logical connection screen displayed for setting of logical connections between equipments in the music LAN 30.

First, an example of the logical connection screen will be explained with reference to FIG. 27. On the logical connection screen 48, a PC 48*a* indicated adjacent to the left side of the screen is the personal computer of FIG. 1 implementing the music processing apparatus 1. Further, "MOTIE_FS" 48*b* and "TRITOIT" 48*c* indicated adjacent to the upper side of the screen represent hardware tone generators externally connected to the music processing apparatus 1 via the music LAN 30, and "SPXX" 48*d* and "SPXY" 48*e* indicated adjacent to the right side of the screen represent hardware effectors externally connected to the music processing apparatus 1 via the music LAN 30. Communication paths (lines) connecting between the PC 48*a* and the hardware tone generators 48*b* and 48*c* and between the PC 48*a* and the hardware effectors 48*d* and 48*e*, as indicated by broken lines, are bidirectional audio communication paths. Pentagon-shaped marks indicated in the individual communication paths each represent communication lines of one direction in the corresponding communication path, and a numerical value within each of the pentagon-shaped marks indicates the number of the communication lines. Lines represented by marks 48*h* with their respective pointed ends oriented toward the PC 48*a* are input lines from the individual equipments to the PC 48*a*, while lines represented by marks 48*i* with their respective pointed ends oriented toward the hardware tone generators 48*b* and 48*c* or hardware effectors 48*d* and 48*e* are output lines from the PC 48*a* to the individual equipments. Between the PC 48*a* and the hardware tone generator 48*b*, for example, there are set one MIDI input line and one MIDI output line, as well as six audio input lines. In this case, one MIDI input port and one MIDI output port and six audio input ports are provided in the PC 48*a* in a software manner.

Desired number of the lines in each of the communication paths can be set on a pop-up menu displayed by the user clicking the mark of the lines. For example, by clicking the mark of the audio input lines for the hardware tone generator 48*b*, the user can change the number of the lines from "6" to a desired number, so that the number within the mark is changed to the desired number. Then, once the user operates an "execute" button 48*f*, music-LAN setting parameters of the PC 48*a* and individual music equipments are controlled in accordance with the thus-set number of the lines and logical connections of the music LAN are established. When the number of the lines between the PC 48*a* and a given music equipment is to be increased, a port for the new connection is generated in the PC 48*a*, while, when the number of the lines between the PC 48*a* and a given music equipment is to be decreased, a corresponding connection port of the PC 48*a* is eliminated. Further, arrangements are made such that, when operation for decreasing the number of the lines has been performed by the user and if one or more lines to be eliminated are currently in use, the intended reduction of the lines is not permitted despite user's operation of the "execute" button 48*f*. Note that the logical connection screen 48 is closed in response to user's operation of a "close" button.

Figure 27:
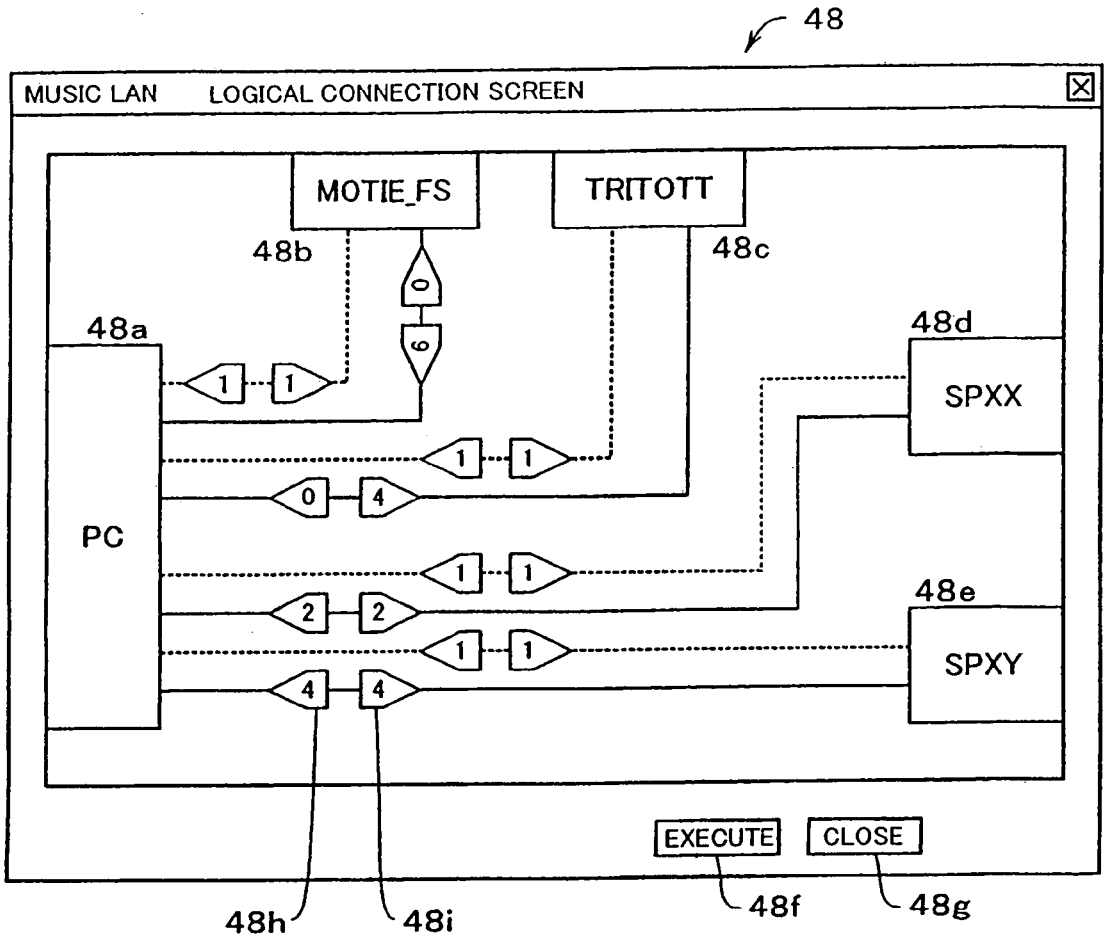
FIG. 27 is a diagram showing an example logical connection screen displaying logical connections in a music LAN of the music processing apparatus of the present invention.

The logical connection change event process is started in response to user's operation of the execute button 48*f* on the logical connection screen 48 of FIG. 27. First, at step S60, a determination is made as to whether the music equipment, for which the logical connection is to be changed, is a hardware tone generator and currently in use after being duly registered in the tone generator rack, or whether the music equipment in question is a hardware effector and currently in use after being inserted in an audio channel. If the music equipment in question has not been registered in the tone generator rack or inserted in an audio channel, the instant process branches to step S63, where the port information of the equipment data of the music equipment in question, stored in the TG library (in the case where the music equipment is a hardware tone generator) or in the EF library (in the case where the music equipment is a hardware effector) is updated to reflect the logical connection state having been changed in response to the connection change event.

Further, when the logical connection of the music equipment registered or inserted has changed as determined at step S60, the process proceeds to step S61, where the port information of the equipment data of the music equipment in question, stored in the TG library (in the case where the music equipment is a hardware tone generator) or in the EF library (in the case where the music equipment is a hardware effector) is updated to reflect the logical connection state having been changed in response to the connection change event. At following step S62, the individual displays are updated in accordance with the logical connection change. More specifically, of the already-connected ports, each port no longer existing due to the logical connection change is placed in the dummy state and displayed in the grey display style. Further, of all unconnected ports, only each port currently existing is displayed on a "port selection menu". When a given port has been restored from the dummy state due to a logical connection change, the grey display of the given port is returned to the normal display. After completion of the operation of step S62 or step S63, the logical connection change event process is brought to an end.

Figure 16:
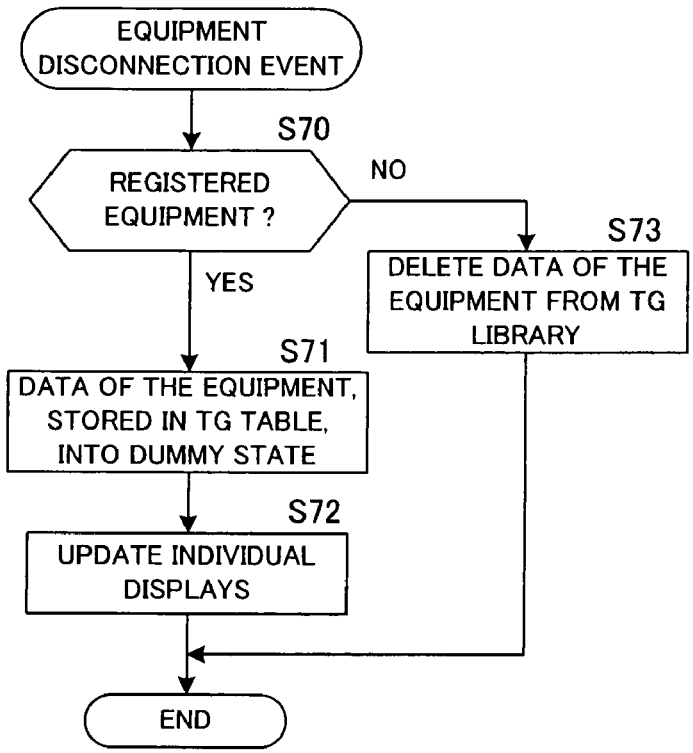
FIG. 16 is a flow chart of an equipment disconnection event process performed in the music processing apparatus of the present invention.

FIG. 16 is a flow chart of an equipment disconnection event process that is started up when a music equipment has been disconnected on the logical connection screen of the music LAN 30, or when a so-far-connected music equipment has been disconnected physically or logically from the music LAN 30 for some reason.

Once the equipment disconnection event process is started up, a determination is made, at step S70, as to whether the music equipment, having been disconnected from the music LAN 30, is a hardware tone generator and currently in use after being registered in the tone generator rack, or whether the music equipment, having been disconnected from the music LAN 30, is a hardware effector and currently in use after being inserted in an audio channel. If the music equipment in question is not registered in the tone generator rack or inserted in an audio channel as determined at step S70, the instant process branches to step S73, where the port information of the equipment data of the music equipment in question, stored in the TG library (in the case where the music equipment is a hardware tone generator) or in the EF library (in the case where the music equipment is a hardware effector) is deleted from the TG or EF library.

If the logical connection of the music equipment registered or inserted has been disconnected from the music LAN 30 as determined at step S70, the equipment data of the music equipment in question, stored in the TG library (in the case where the music equipment is a hardware tone generator) or in the EF library (in the case where the music equipment is a hardware effector), is placed in the dummy state, and setting data corresponding thereto is hold in the parameter memory (i.e., the working memory area of the RAM 4 or the predetermined working area on the hard disk 3A or flash memory 3B in FIG. 28) in the music processing apparatus 1. At following step S72, all displays, in the music processing apparatus 1, pertaining to the equipment data having been placed in the dummy state are placed in the dummy state. More specifically, displays of the equipment name etc. of the music equipment in question, which are currently performed in the tone generator rack, audio channel strip etc. on the basis of the equipment data of the equipment in question, are placed in the dummy state and changed to the grey display style. Further, control is performed to prevent the data of the music equipment in question from being displayed on various selection menus. After completion of the operation of step S72 or step S73, the disconnection event process is brought to an end. Because the ports of the music processing apparatus 1, to which the disconnected equipment was being connected, are automatically caused to disappear when the music equipment has been disconnected, the ports disappears from the port selection menu displayed in the audio channel strip etc. without particular control being performed.

Figure 17:
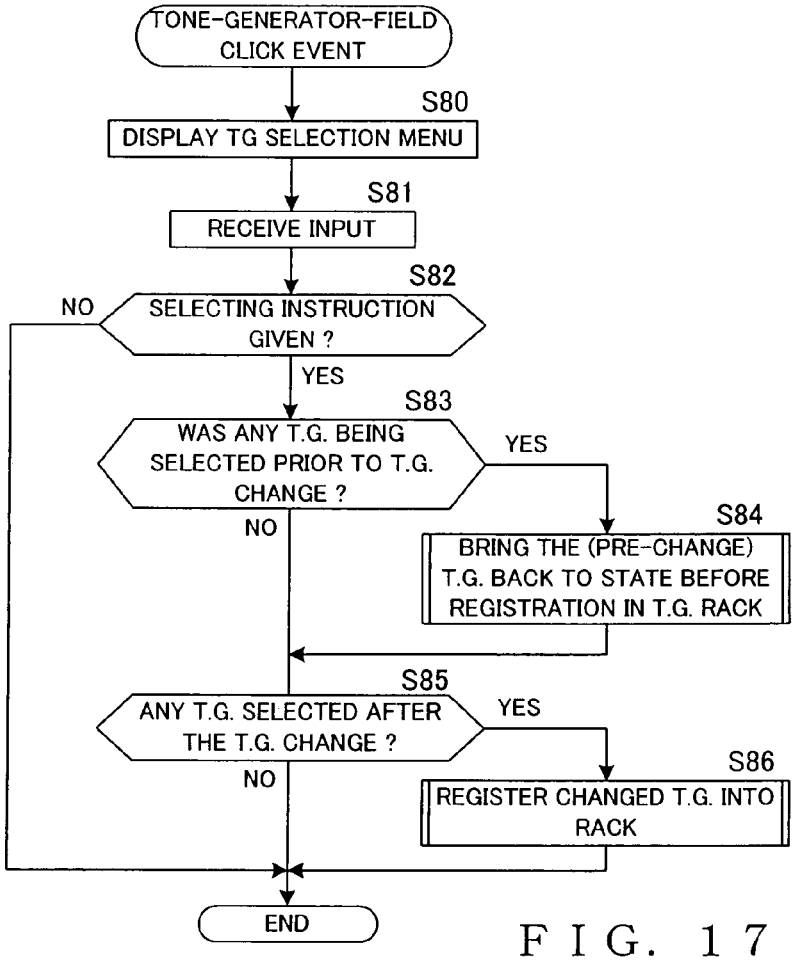
FIG. 17 is a flow chart of a tone-generator-name-field click event process performed in the music processing apparatus of the present invention.

FIG. 17 is a flow chart of a tone-generator-name-field click event process that is started up in response to clicking of a desired tone generator name field in the tone generator rack.

Once the tone-generator-name-field click event process is started up, the TG selection menu is displayed at step S80. Hardware tone generators currently registered in the TG table and plugged-in software tone generators are displayed on the TG selection menu, but each tone generator already registered in the tone generator rack is displayed in the grey display style, or not displayed at all, so that it can not be selected any longer. Then, a user's input to the TG selection menu is received at step S81, and a determination is made, at step S82, as to whether the user's input is a selecting instruction. If the user's input is a selecting instruction as determined at step S82, the instant process proceeds to step S83 to further determine whether any tone generator was being selected in the clicked tone generator name field prior to the selecting instruction (tone generator change). If any tone generator was being selected in the clicked tone generator name field prior to the selecting instruction (tone generator change) as determined at step S83, the instant process branches to step S84, where a process is performed for bringing the tone generator (T.G.), selected prior to the change, (i.e., pre-change tone generator) back to a state before the T.G. was registered in the tone generator rack, i.e. back to a previous state the T.G. was in before registration in the rack. After completion of the operation of step S84, or if no tone generator was being selected in the clicked tone generator name field prior to the selecting instruction (prior to the tone generator change) as determined at step S83, the process proceeds to step S85, where a further determination is made as to whether any one of the tone generators displayed on the TG selection menu has been selected by the selecting instruction, i.e. whether any tone generator has been selected in the clicked tone generator name field after the selecting instruction (after the tone generator change). If any tone generator has been selected in the clicked tone generator name field after the selecting instruction (after the tone generator change) as determined at step S85, the instant process branches to step S86, where the changed (i.e., changed-to) tone generator is registered in the tone generator rack. After completion of the operation of step S86, or if a mark "–" displayed on the TG selection menu has been selected to instruct removal of the tone generator and no tone generator has been selected in the clicked tone generator name field as determined at step S85, the tone-generator-name-field click event process is brought to an end. If, on the other hand, no selecting instruction has been given, for example, by the user clicking a region other than the TG selection menu as determined at step S82, the tone-generator-name-field click event process is terminated.

Figure 18:
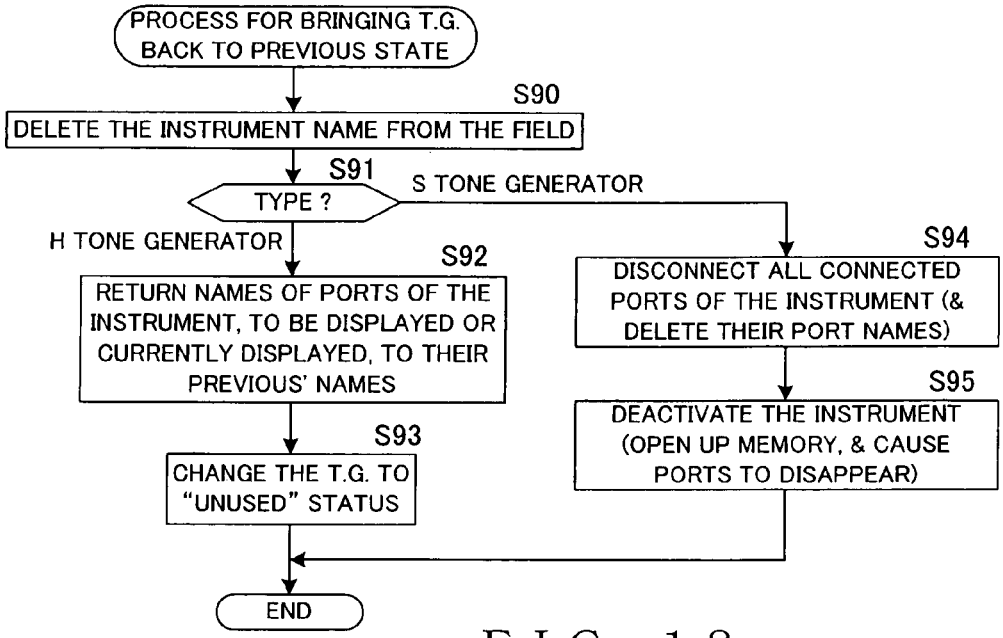
FIG. 18 is a flow chart of a process performed, in the tone-generator-name-field click event process, for bringing a tone generator back to a state before registration in the tone generator rack.

FIG. 18 is a flow chart of the process performed, at step S84 in the aforementioned tone-generator-name-field click event process, for bringing the tone generator, selected prior to the change, (i.e., pre-change tone generator) back to the state before it was registered in the tone generator rack.

First, at step S90 of FIG. 18, the tone generator name (musical instrument name) in question is deleted from the tone generator name field of the tone generator rack. At next step S91, a determination is made as to the type of the tone generator, i.e. whether the tone generator is a hardware (H) tone generator or a software (S) tone generator. If the tone generator is a hardware tone generator as determined at step S91, the instant process proceeds to step S92, where, of port names to be displayed or currently displayed in the music processing apparatus 1, the names of the ports designated, by the equipment data of the hardware tone generator (musical instrument), as ports of connection with the hardware tone generator are returned to their previous names. Further, if association with any editor has been set in the equipment data, the editor currently activated is deactivated, and a parameter storage region, in the working memory area of the RAM 4 in the music processing apparatus 1, corresponding to the tone generator (musical instrument) is opened up. At next step S93, the musical instrument in question is changed to an "unused" status, so that the "×" mark is removed from the "use" field of the external tone generator registration screen 46. If, on the other hand, the tone generator is a software tone generator as determined at step S93, the instant process branches to step S94, where all of connected ports of the software tone generator (musical instrument) are disconnected and their port names are deleted. At following step S95, the program of the software tone generator is deactivated, so that corresponding ports are caused to disappear and the parameter storage region so far secured is opened up. After completion of the operation of step S93 or step S95, the process of FIG. 18 for bringing the tone generator back to the previous state is brought to an end, and control returns to step S85 of the tone-generator-name-field click event process.

Figure 19:
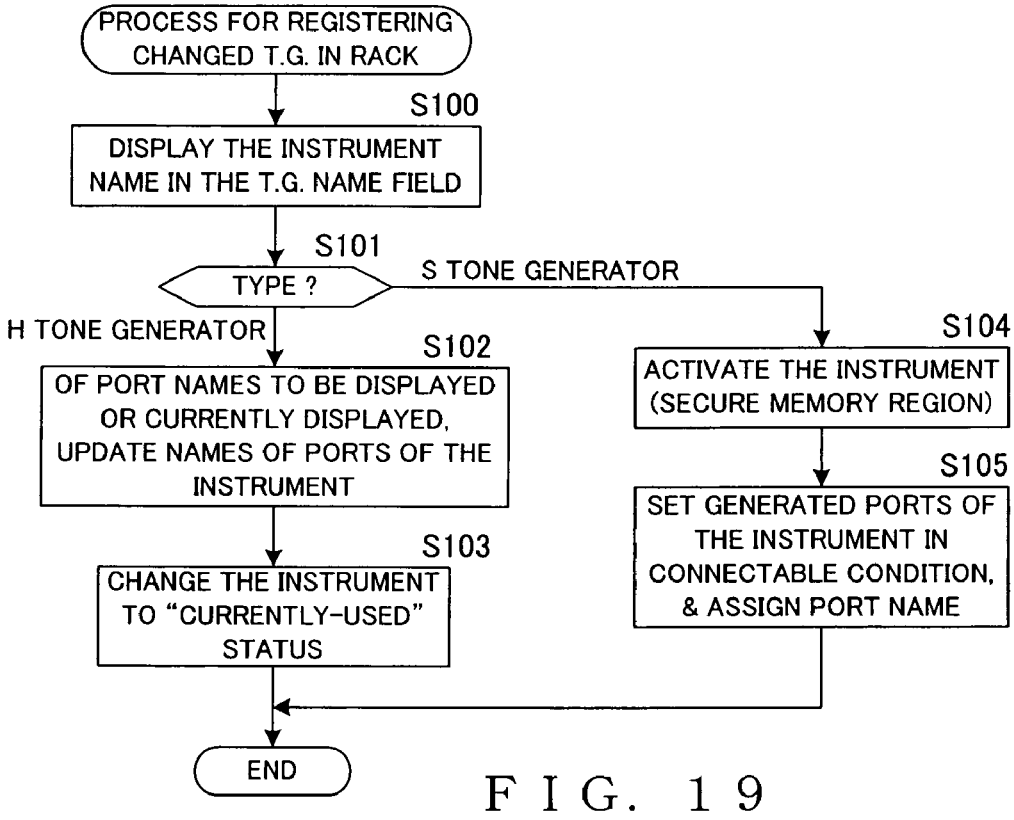
FIG. 19 is a flow chart of a process performed, in the tone-generator-name-field click event process, for registering a changed-to tone generator in the tone generator rack.

Further, FIG. 19 is a flow chart of the process performed, at step S86 in the aforementioned tone-generator-name-field click event process, for registering the changed (i.e., changed-to) tone generator in the tone generator rack.

At step S100 of FIG. 19, the tone generator name (musical instrument name) in question is displayed in the tone generator name field. At next step S101, a determination is made as to the type of the tone generator, i.e. whether the tone generator is a hardware tone generator or a software tone generator. If the tone generator is a hardware tone generator as determined at step S101, the instant process proceeds to step S102, where, of the port names to be displayed or currently displayed in the music processing apparatus 1, the names of the ports designated, by the equipment data of the hardware tone generator (musical instrument), as ports of connection with the hardware tone generator are updated with the name of the hardware tone generator (musical instrument) in question on the basis of the equipment data. Further, if association with any editor has been set in the equipment data, the program of that editor is activated, and a storage region for parameters for remote-controlling the hardware tone generator (musical instrument) is secured in the working memory area of the RAM 4. At next step S103, the musical instrument in question is changed to a "currently-used" status, so that the "×" mark is displayed in the "use" field of the external tone generator registration screen 46. If, on the other hand, the tone generator is a software tone generator as determined at step S101, the instant process branches to step S104, where the program of the software tone generator (musical instrument) is activated, so that a storage region for storing parameters of the software tone generator is secured in the working memory area of the RAM 4 and ports for connecting the software tone generator are generated. At following step S105, the thus-generated ports are each set in a connectable condition and assigned a port name identical to the name of the software tone generator (musical instrument). After completion of the operation of step S103 or step S105, the process of FIG. 19 for registering the changed (i.e., changed-to) tone generator in the tone generator rack is brought to an end, and control returns to the tone-generator-name-field click event process.

Figure 20:
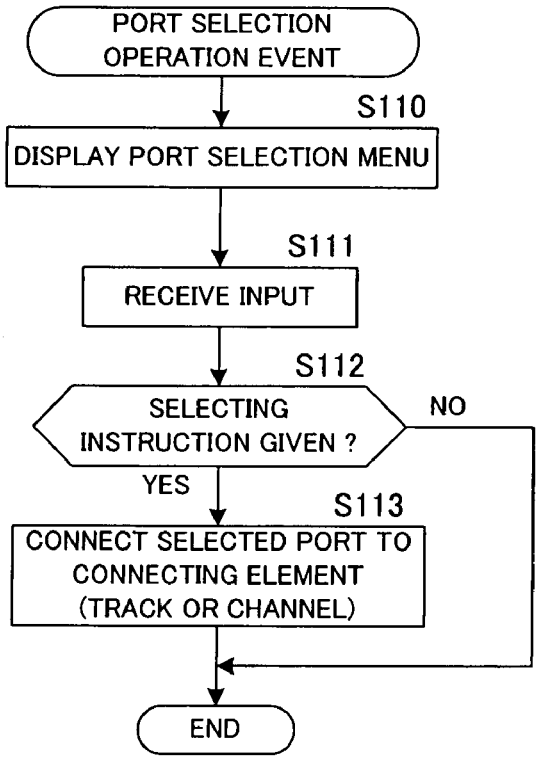
FIG. 20 is a flow chart of a port selection operation event process performed in the music processing apparatus of the present invention.

Further, FIG. 20 is a flow chart of a port selection operation event process that is started up in response to clicking of a port field of a MIDI track, MIDI mixer, audio track, audio mixer or the like (40*d*, 44*a*, 44*b*, or the like) or "port selection" menu.

Once the port selection operation event process is started up, the port selection menu is displayed at step S110, and a user's input is received at step S111. Names of ports for connection with tone generators and names of ports for connection with effectors are displayed on the port selection menu with predetermined names assigned thereto; specifically, for tone generators registered in the tone generator rack, the names of these tone generators are assigned to the ports for connection with tone generators, and, for effectors registered in the EF table, the names of these effectors are assigned to the ports for connection with effectors, so that any desired one of the ports can be readily selected intuitively by the user. At step S112, a determination is made as to whether the received user's input is a selecting instruction. If the user's input is a selecting instruction as determined at step S112, the instant process proceeds to step S113 to connect the selected port to a MIDI/audio track or MIDI/audio channel that is a connecting element. Because each port is connected to only one connecting element, the port selection menu is updated so that no already-selected port is displayed thereon. After completion of the operation of step S113, the port selection operation event process is brought to an end. If no selecting instruction has been given, for example, by the user clicking a region other than the port selection menu as determined at step S112, the port selection operation event process is terminated.

Figure 21:
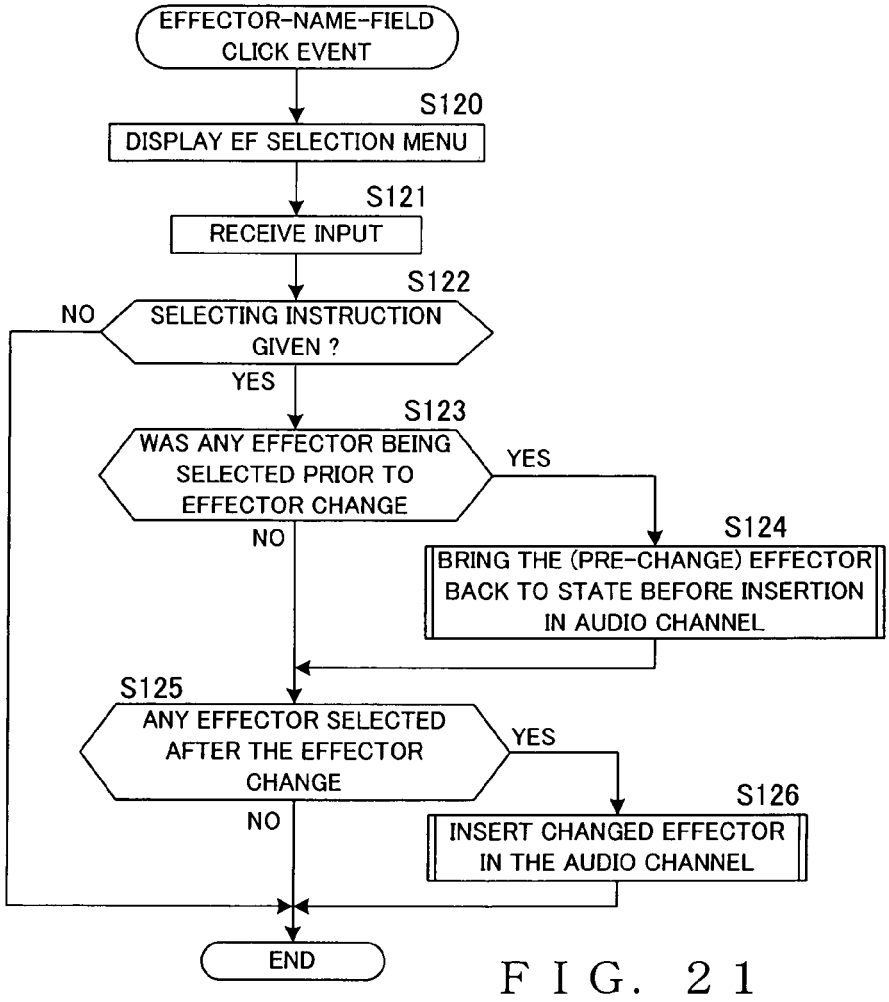
FIG. 21 is a flow chart of an effector-name-field click event process performed in the music processing apparatus of the present invention.

FIG. 21 is a flow chart of an effector-name-field click event process that is started up in response to clicking of an effector name field (e.g., 44*c*) of a desired audio channel strip in the audio mixer.

Once the effector-name-field click event process is started up, the EF selection menu is displayed at step S120. Hardware effectors currently registered in the EF table and plugged-in software effectors are displayed on the EF selection menu, but each effector already registered in an audio channel is displayed in the grey display style, or not displayed at all, so that it can not be selected by the user. Then, a user's input to the EF selection menu is received at step S121, and a determination is made, at step S122, as to whether the user's input is a selecting instruction. If the user's input is a selecting instruction as determined at step S122, the instant process proceeds to step S123 to further determine whether any effector was being selected in the clicked effector name field prior to the selecting instruction (effector change). If any effector was being selected in the clicked effector name field prior to the selecting instruction (effector change) as determined at step S123, the instant process branches to step S124, where a process is performed for bringing the effector selected prior to the change (i.e., pre-change effector) back to a state before it was inserted in the audio channel (i.e., to a previous state the effector was in prior to the insertion in the audio channel). After completion of the operation of step S124, or if no effector was being selected in the clicked effector name field prior to the selecting instruction (prior to the effector change) as determined at step S123, the process proceeds to step S125, where a further determination is made as to whether any one of the effectors displayed on the EF selection menu has been selected by the selecting instruction, i.e. whether any one of the effectors displayed on the EF selection menu has been selected by the input of the selecting instruction, i.e. whether any effector has been selected in the clicked effector name field after the effector change. If any effector has been selected in the clicked effector name field as determined at step S125, the instant process branches to step S126, where a process is performed for inserting the changed (i.e., changed-to) effector in the audio channel. After completion of the operation of step S126, or if the mark "–" displayed on the EF selection menu has been selected to instruct removal of the effector and no effector has been selected in the clicked effector name field as determined at step S125, the effector-name-field click event process on the desired channel of the audio mixer is brought to an end. If, on the other hand, no selecting instruction has been input, for example, by the user clicking a region other than the EF selection menu as determined at step S122, the effector-name-field click event process is terminated.

Figure 22:
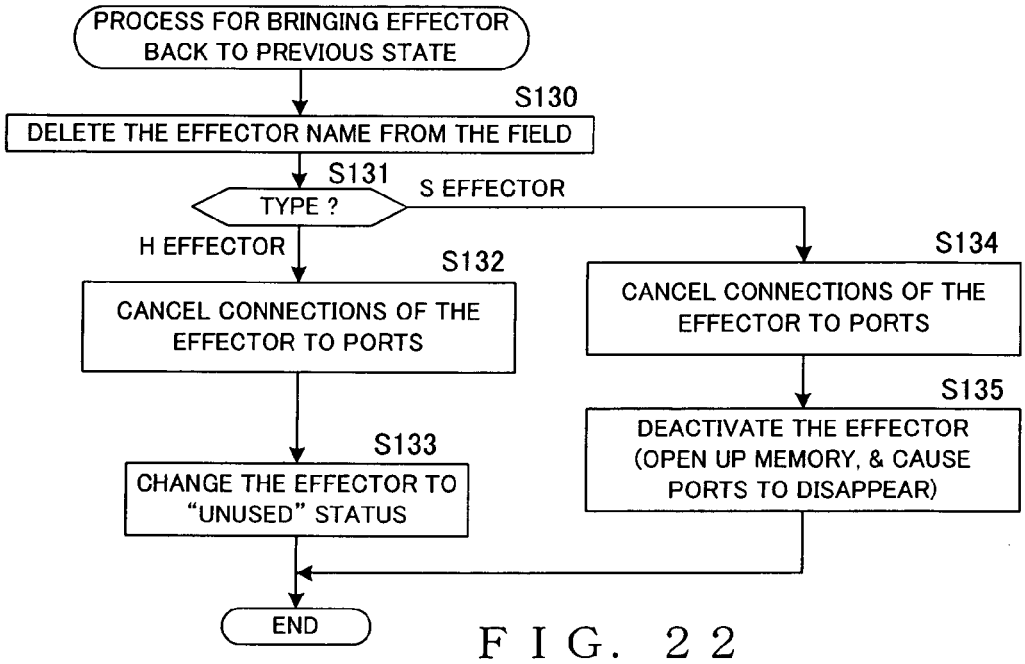
FIG. 22 is a flow chart of a process performed, in the effector-name-field click event process, for bringing a pre-change effector back to a state before insertion in the audio channel.

FIG. 22 is a flow chart of the process performed, at step S124 in the aforementioned effector-name-field click event process, for bringing the pre-change effector back to the state before insertion in the audio channel.

Once the process of FIG. 22 is started up, the effector name in question is deleted from the effector name field of the audio channel. At next step S131, a determination is made as to the type of the effector, i.e. whether the effector is a hardware (H) effector or a software (S) effector. If the effector is a hardware effector as determined at step S131, the instant process proceeds to step S132, where an insertion/connection cancellation process is carried out for canceling connections to input/output ports, designated by the equipment data of the hardware effector, to cause audio signals to pass through the insertion point, i.e. to jump over the hardware effector located at the insertion point. Further, if association with any editor has been set in the equipment data, the editor currently activated is deactivated, and a parameter storage region, in the music processing apparatus 1, of the hardware effector is opened up. At next step S133, the effector in question is changed to an "unused" status. If, on the other hand, the effector is a software effector as determined at step S131, the instant process branches to step S134, where an insertion/connection cancellation process is carried out for removing the ports of the software effector from the insertion point to cause audio signals to pass through the insertion point. At following step S135, the program of the software effector is deactivated, so that corresponding ports are caused to disappear and the parameter storage region so far secured is opened up. After completion of the operation of step S133 or step S135, the process of FIG. 22 is brought to an end, and control returns to step S125 of the effector-name-field click event process on the desired channel of the audio mixer.

Figure 23:
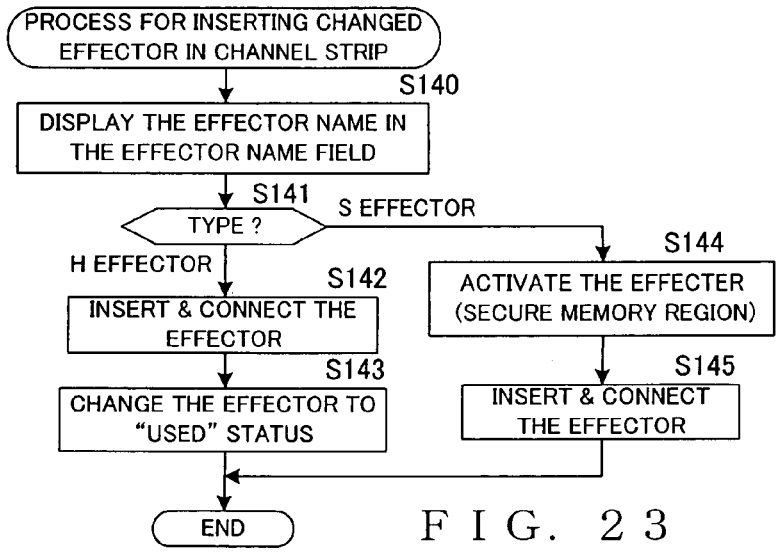
FIG. 23 is a flow chart of a process performed, in the effector-name-field click event process, for inserting a changed-to effector in a channel strip.

FIG. 23 is a flow chart of the process performed, at step S126 in the aforementioned effector-name-field click event process, for inserting the changed effector in the channel strip.

At step S140 of FIG. 23, the effector name in question is displayed in the effector name field of the audio channel. At next step S141, a determination is made as to the type of the effector, i.e. whether the effector is a hardware effector or a software effector. If the effector is a hardware effector as determined at step S141, the instant process proceeds to step S142, where audio signal input/output ports, designated by the equipment data of the hardware effector as connection ports with the hardware effector, are inserted and connected to the insertion point of the audio channel. Further, if association with any editor has been set in the equipment data, the program of that editor is activated, and a storage region for parameters for remote-controlling the hardware effector is secured. At next step S143, the effector in question is changed to a "currently-used" status. If, on the other hand, the effector is a software effector as determined at step S141, the instant process branches to step S144, where the program of the software effector is activated, so that a storage region for storing parameters of the software effector is secured and audio signal input/output ports for connecting the software effector are generated. At following step S145, the thus-generated ports are each set in a connectable state and inserted and connected to the insertion point of the audio channel. After completion of the operation of step S143 or step S145, the process of FIG. 23 for inserting the changed effector in the channel strip is brought to an end, and control returns to the effector-name-field click event process on the desired channel of the audio mixer.

Figure 24:
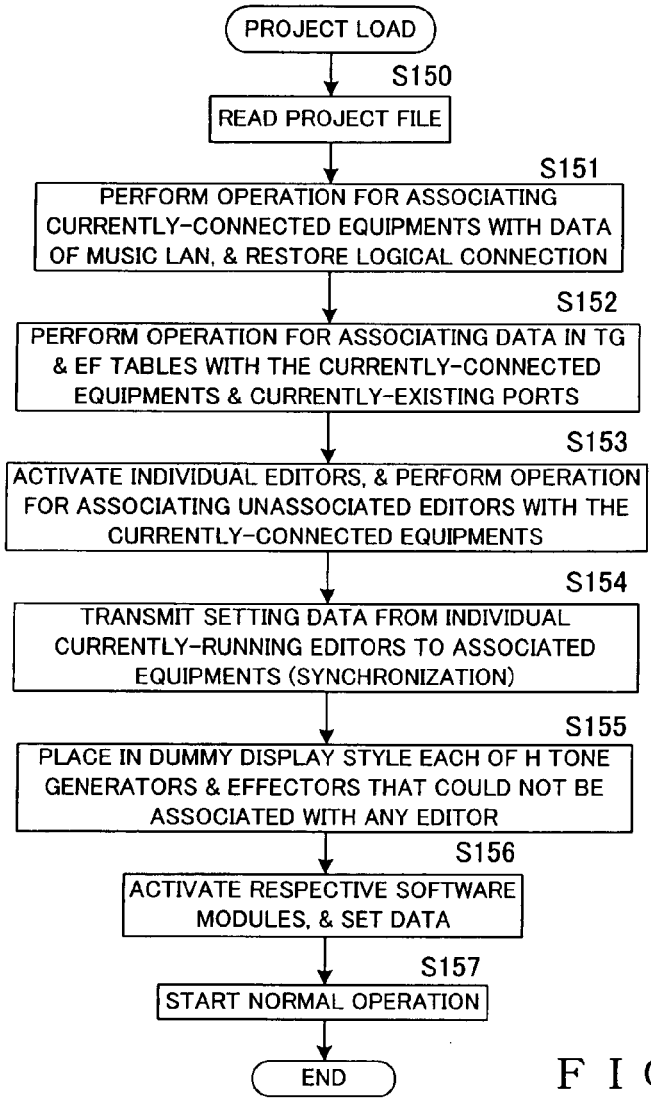
FIG. 24 is a flow chart of a project load process performed in the music processing apparatus of the present invention.

Further, FIG. 24 is a flow chart of a project load process for loading a project file into the music processing apparatus 1.

Once loading of the project file is selected from a file menu of the music processing apparatus 1, a project load command is issued in response to the selection of the loading of the project file, and a project load processing routine is activated in response to the issued project load command. The project load process of FIG. 24 is started and performed by the activated project load processing routine. At first step S150 of FIG. 24, the project file stored in the memory device (e.g., the hard disk 3A, flash memory 3B, etc.), the data format of which is as shown in FIG. 4, is read out from the memory device and written into the working memory area of the RAM 4. At step S151, hardware tone generators and hardware effectors, currently connected via the music LAN 30 to the music processing apparatus 1, are detected, and an operation is performed for associating the thus-detected currently-connected music equipments with data of the music LAN contained in the read project file, and logical connections of each of the hardware tone generators and hardware effectors that could be associated are restored. Then, at step S152, an operation is performed for associating the individual equipment data registered in the TG table and EF table in the read project file with the music equipments in the form of hardware tone generators and hardware effectors, and also an operation is performed for associating the individual equipment data with currently-existing input and output ports of the music processing apparatus 1. Because the equipment name and ID of each music equipment connected to the music LAN 30 can be identified by the music processing apparatus 1 inquiring of the music equipment, the equipment data and the music equipments may be associated rigorously or strictly up to the serial numbers, or the equipment data and the music equipments with the same model ID may be associated even where they differ in serial number. Further, because it is possible to acquire information as to which ports each of the music equipments connected to the music LAN 30 is currently connected to, the port information of the equipment data registered in the TG or EF table is modified on the basis of the acquired information. For fixed ports other than the music LAN 30, it is not possible to identify music equipments connected with the ports, and thus, the ports are associated with music equipments unconditionally in accordance with the equipment data registered in the TG or EF table. In such a case, each of the music equipments connected to the ports can be used with no particular problem unless the music equipment has been changed after the storage of the project file, although there is no absolute guarantee that the music equipment is being connected to the ports.

Further, at step S153, the editor associated by each of the equipment data registered in the TG and RF tables is activated. The thus-activated editor for each hardware tone generator uses data of the hardware tone generator, contained in the read project file, as remote-controlling parameters, and similarly the thus-activated editor for each hardware effector uses data of the hardware effector, contained in the read project file, as remote-controlling parameters. Here, an operation is performed for associating unassociated editors, using fixed control ports other than the music LAN, with the control ports. Then, at step S154, after confirming with the user as to whether or not parameter synchronization should be effected, setting data are transferred from the individual currently-running editors to the respective associated music equipments to thereby effect the parameter synchronization. In the aforementioned manner, for each of the music equipments connected to the music LAN 30, not only logical paths for interconnecting the music processing apparatus 1 and the music equipment but also parameters are restored irrespective of whether or not the ports have been changed after the storage of the project file. Further, each of the hardware tone generators and hardware effectors that could not be associated with any editor although registered in the TG table and EF table is placed, at step S155, in the dummy (or grey) display style. At following step S156, respective software modules of currently-plugged-in software tone generators and software effectors are activated, and respective operating states are restored in accordance with the data of the read project file. For example, the track data, included in the read project file, are stored in a track data memory provided in the hard disk 3A or flash memory 3B or RAM 4 in FIG. 28 as well as the parameters are stored in the parameter memory provided in the hard disk 3A or flash memory 3B or RAM 4. Normal operation is started, at next step S157, so that previous states when the project file was stored are restored, after which the instant project load process is brought to an end.

Figure 25:
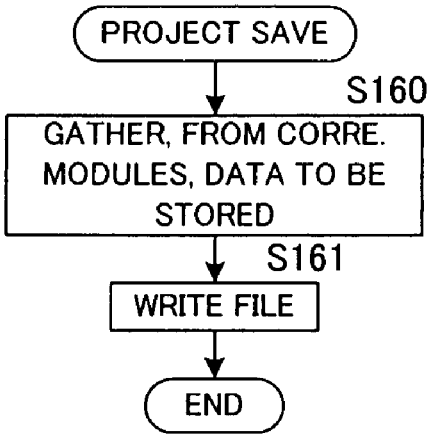
FIG. 25 is a flow chart of a project save process performed in the music processing apparatus of the present invention.

Further, FIG. 25 is a flow chart of a project save process for saving a project file in the music processing apparatus 1.

When the user has selected saving of the project file from the file menu of the music processing apparatus 1, a project save command is issued in response to the selection of the saving of the project file, and a project save processing routine is activated in response to the issued project save command. The project save process of FIG. 25 is started and performed by the activated project save processing routine. At step S160, individual data constituting the project file of FIG. 4 are gathered from corresponding modules of the music processing apparatus 1. Then, at step S161, the project file constituted by the data gathered at step S161 is written into the memory device (e.g., the hard disk 3A, flash memory 3B, etc.) in the music processing apparatus 1 and saved therein. After that, the project save process is brought to an end.

Figure 26:
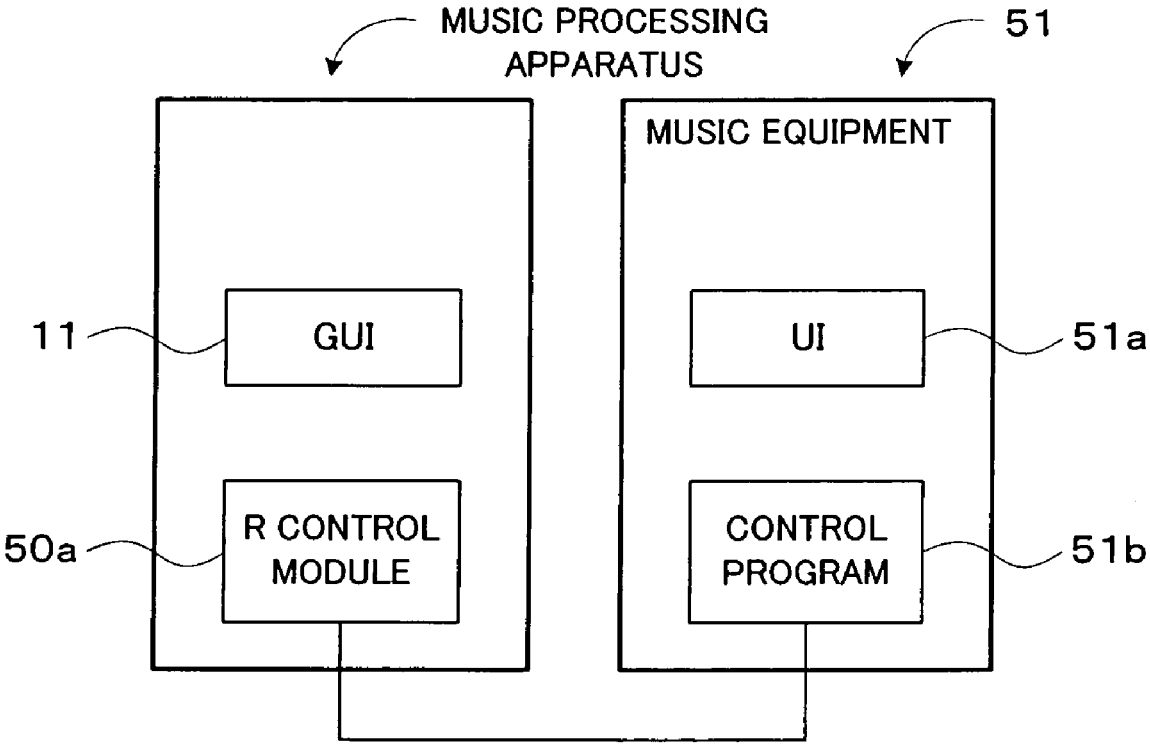
FIG. 26 is a diagram schematically shows how remote control is performed when a music equipment has been connected to the music processing apparatus.

FIG. 26 schematically shows a manner in which remote control is performed by an editor (remote control software) for a music equipment connected to the music processing apparatus 1. In the illustrated example of FIG. 26, a remote-controlling communication path interconnecting the music processing apparatus 1 and the music equipment is any of a MIDI communication path, serial communication path, serial communication path of the music LAN, Ethernet and the like, and a control port connected to each music equipment is identified by the music processing apparatus 1. The editor activated in the music processing apparatus 1 includes the GUI control section 11 for interfacing with the user via the display device and operators of the PC, and an R control module for, in accordance with instructions given from the user via the GUI control section 11, editing remote-controlling parameters stored in the music processing apparatus 1 and remote-controlling the music equipment 51. The music equipment 51 includes at least a UI section 51*a* for interfacing with the user via the display and operators of the equipment 51, and a control program 51*b* for editing parameters, stored in the music equipment, in accordance with instructions given from the user via the UI section 51*a* or remote control by the music processing apparatus 1, and controlling behavior of the music equipment remote-controlling on the basis of the edited parameters. In starting the remote control of the music equipment 51, remote-controlling parameters within the music processing apparatus 1 are transferred to the music equipment 51, via the remote-controlling communication path, through the function of the R control module 50*a* and the control program 51*b* sets parameters in the music equipment 51 on the basis of the transferred data, so that the parameters are synchronized between the music processing apparatus 1 and the music equipment 51.

After that, control is performed such that the parameters of the music processing apparatus 1 and the parameters of the music equipment 51 are synchronized, via the remote-controlling communication path and through the functions of the R control module 50*a* and control program 51*b*, in both of a case where the editor is activated in the apparatus 1 and the parameters are edited using the GUI control section 11 and a case where the parameters are edited in the music equipment 51 using the UI section 51*a*. Note that, when the music equipment 51 is switched from the dummy state to the currently-operating state too, the parameters of the music processing apparatus 1 and the parameters of the music equipment 51 are synchronized via the remote control.

Although each disconnected music equipment is displayed in the dummy (or grey) display style as set forth above, parameters of the music equipment in the dummy state can be edited by the controlling editor provided in the music processing apparatus 1. Then, when the music equipment has been re-connected, the parameters edited by the controlling editor are transferred to the re-connected music equipment to effect the parameter synchronization.

The preferred embodiment, having been described above, allows a user's favorite hardware tone generator, registered in the TG library, to be registered in the tone generator rack by registering it into the TG table. Alternatively, the hardware tone generator may be registered into the TG table when it has been externally connected to the music processing apparatus 1. Because new hardware tone generators are often connected to the music processing apparatus when they are to be actually used, a desired hardware tone generator may be registered directly in the tone generator rack when it has been externally connected to the music processing apparatus. These forms of music equipment registration are also applicable to hardware effectors.

Further, even when an external equipment detected as disconnected from the music processing apparatus has been placed in the dummy display style, remote control software of the equipment may be allowed to edit parameters; with this arrangement, the parameters can be acquired by the remote control software even where the equipment is not at hand.

Further, performance event data for driving a tone generator are not limited to MIDI event data and may be any of various types of performance event data that can designate tone colors of individual parts of the tone generator and pitch intensity and timing of tones to be generated.

Further, the above-describe embodiment is arranged to inhibit each hardware tone generator placed in the dummy state from being selected on the TG selection menu of the tone generator rack. Alternatively, selection of such a hardware tone generator placed in the dummy state may be permitted for purposes of, for example, parameter acquisition (i.e., in order to set in advance various parameters of tone generators and effectors into desired states, before a tone generators and effector are actually connected to perform various operations, such as recording and editing). However, because such a hardware tone generator is not actually connected, no corresponding audio signal will be returned from the hardware tone generator even when a MIDI event is sent.

Furthermore, the embodiment of the present invention is arranged in such a manner that, when an equipment detected as connected to the music LAN has been associated with any music equipment placed in the dummy state, the dummy-style display is switched to the "currently-operating" display after parameters of the associated music equipment are transferred and synchronized. Alternatively, only the display switching may be made without the synchronization being performed.

What is claimed is:

1. A music processing apparatus capable of performing music processing including reproduction of performance of at least one of events and audio signals, said music processing apparatus being capable of registering plug-in software, having a predetermined music function, into a rack object to thereby use the music function of the plug-in software in part of the music processing, said music processing apparatus comprising:

a first interface section that connects said music processing apparatus to a music network capable of real-time transmission of the performance of at least one of events and audio signals;

a storage section that stores, for each equipment registered for use in said music processing apparatus, equipment data including a name of the equipment and information of a connection port to be used for connecting the equipment to the music processing of said music processing apparatus;

a library section capable of storing a plurality of sets of the equipment data;

a connection detection section that detects an external equipment newly connected to the network and having a music function identical in type to the music function of the plug-in software and that generates equipment data of the detected external equipment on the basis of information acquired from the detected external equipment;

an automatic registration section that, when connection of an external equipment is newly detected by said connection detection section and if the newly detected external equipment has not yet been registered for use, causes equipment data of the newly detected external equipment to be stored into said library section;

a use-registration section that, in response to operation by a user, selects any one of a plurality of equipments, having their respective equipment data stored in said library section, to register the selected equipment for use and writes the equipment data of the selected equipment into said storage section, and that, when the selected equipment having been registered for use is the external equipment detected by said connection detection section, deletes the equipment data of the external equipment from said library section; and a rack registration section that, in response to operation by the user, registers the equipment, having been registered for use, into the rack object, wherein the music function of the equipment registered in the rack object is usable as part of the music processing in a substantially same manner as the music function of the plug-in software.

2. A music processing apparatus as claimed in claim 1 which further comprises a second interface that directly inputs and outputs the performance of at lest one of events and audio signals.

3. A music processing apparatus as claimed in claim 1 wherein the plug-in software is activated when the plug-in software has been registered into the rack object, and wherein operational data for controlling the plug-in software is stored in said music processing apparatus, and processing of the plug-in software is logically connected to the music processing of said music processing apparatus via a virtual input and output port.

4. A music processing apparatus as claimed in claim 1 wherein, when any one of the external equipments, registered for use, has been registered into the rack object, logical connection of the one external equipment with the music processing of said music processing apparatus in made via input and output ports based on port designation information included in the equipment data of the one external equipment.

5. A music processing apparatus as claimed in claim 1 which further comprises a plurality of remote control software for remote-controlling respective ones of the plurality of equipments, and wherein the equipment data of each of the equipments includes link information indicative of the remote control software for controlling the equipment, and, when the equipment has been registered into the rack object, the remote control software indicated by the link information is activated and parameter information for remote-controlling the equipment is stored into said music processing apparatus.

6. A music processing apparatus as claimed in claim 5 which further comprises:

a disconnection detection section that detects disconnection, from the music network, of an external equipment so far connected to the music network; and a dummying section that, when the disconnection is detected by said disconnection detection section and if the equipment disconnected from the music network has been registered for use, changes a style of visual display, in said music processing apparatus, of data pertaining to the disconnected equipment from a normal display style to a dummy display style.

7. A music processing apparatus as claimed in claim 6 which further comprises a normalization section that, when connection of an equipment is newly detected by said connection detection section and if the newly detected equipment has already been registered for use, returns the style of visual display, in said music processing apparatus, of data pertaining to the newly detected equipment from the dummy display style to the normal display style.

8. A music processing apparatus as claimed in claim 7 which further comprises a synchronization section that, when the style of visual display of a given equipment is to be returned, via said normalization section, to the normal display style, transmits the operational data, stored in said music processing apparatus for controlling the given equipment, to the given equipment via the music network and sets the operational data, received by the given equipment, in the given equipment to thereby synchronize data of said music processing apparatus and data of the given equipment.

9. A music processing apparatus as claimed in claim 1 which further comprises:

a disconnection detection section that detects disconnection, from the music network, of an external equipment so far connected to the music network; and an automatic deletion section that, when the disconnection is detected by said disconnection detection section and if the equipment data of the external equipment disconnected from the music network is included in said library section, deletes the equipment data of the disconnected external equipment from said library section.

10. A management method for a music processing apparatus capable of performing music processing including reproduction of performance of at least one of events and audio signals, said music processing apparatus being capable of registering plug-in software, having a predetermined music function, into a rack object to thereby use the music function of the plug-in software in part of the music processing, said music processing apparatus including: a first interface section that connects said music processing apparatus to a music network capable of real-time transmission of the performance of at least one of events and audio signals; a storage section that stores, for each equipment registered for use in said music processing apparatus, equipment data including a name of the equipment and information of a connection port to be used for connecting the equipment to the music processing of said music processing apparatus; and a library section capable of storing a plurality of sets of the equipment data, said management method comprising:

a step of detecting an external equipment newly connected to the network and having a music function identical in type to the music function of the plug-in software and generating equipment data of the detected external equipment on the basis of information acquired from the detected external equipment;

a step of, when connection of an external equipment is newly detected by said step of detecting and if the newly detected external equipment has not yet been registered for use, causing equipment data of the newly detected external equipment to be stored into the library section;

a step of, in response to operation by a user, selecting any one of a plurality of equipments, having their respective equipment data stored in the library section, to register the selected equipment for use and writing the equipment data of the selected equipment into the storage section, and deleting the equipment data of the external equipment from the library section when the selected equipment having been registered for use is the external equipment detected by said step of detecting; and a step of, in response to operation by the user, registering the equipment, having been registered for use, into the rack object, wherein the music function of the equipment registered in the rack object is usable as part of the music processing in a substantially same manner as the music function of the plug-in software.

11. A computer-readable recording medium containing a group of instructions to cause a computer of a music processing apparatus to perform a management procedure, said music processing apparatus being capable of performing music processing including reproduction of performance of at least one of events and audio signals, said music processing apparatus being capable of registering plug-in software, having a predetermined music function, into a rack object to thereby use the music function of the plug-in software in part of the music processing, said music processing apparatus including: a first interface section that connects said music processing apparatus to a music network capable of real-time transmission of the performance of at least one of events and audio signals; a storage section that stores, for each equipment registered for use in said music processing apparatus, equipment data including a name of the equipment and information of a connection port to be used for connecting the equipment to the music processing of said music processing apparatus; and a library section capable of storing a plurality of sets of the equipment data, said management procedure comprising:

a step of detecting an external equipment newly connected to the network and having a music function identical in type to the music function of the plug-in software and generating equipment data of the detected external equipment on the basis of information acquired from the detected external equipment;

a step of, when connection of an external equipment is newly detected by said step of detecting and if the newly detected external equipment has not yet been registered for use, causing equipment data of the newly detected external equipment to be stored into the library section;

a step of, in response to operation by a user, selecting any one of a plurality of equipments, having their respective equipment data stored in the library section, to register the selected equipment for use and writing the equipment data of the selected equipment into the storage section, and deleting the equipment data of the external equipment from the library section when the selected equipment having been registered for use is the external equipment detected by said step of detecting; and a step of, in response to operation by the user, registering the equipment, having been registered for use, into the rack object, wherein the music function of the equipment registered in the rack object is usable as part of the music processing in a substantially same manner as the music function of the plug-in software.

* * * * *